US005273864A

United States Patent [19]

Ishikawa et al.

[11] Patent Number: 5,273,864

[45] Date of Patent: Dec. 28, 1993

[54] PROCESSING METHOD FOR SILVER HALIDE COLOR PHOTOGRAPHIC MATERIAL

[75] Inventors: Takatoshi Ishikawa; Nobuo Sakai; Minoru Sakai, all of Minami-ashigara, Japan

[73] Assignee: Fuji Photo Film Co., Ltd., Minami-ashigara, Japan

[21] Appl. No.: 530,413

[22] Filed: May 29, 1990

Related U.S. Application Data

[63] Continuation of Ser. No. 5,893, Jan. 22, 1987, abandoned.

[30] Foreign Application Priority Data

Jan. 23, 1986 [DE] Fed. Rep. of Germany ..... 13413
Mar. 31, 1986 [JP] Japan ..... 61-73596
Jun. 18, 1986 [JP] Japan ..... 61-142609

[51] Int. Cl.[5] ..... G03C 7/384

[52] U.S. Cl. ..... 430/387; 430/393; 430/463; 430/558

[58] Field of Search ..... 430/398, 399, 380, 434, 430/464, 467, 558, 372, 461, 463

[56] References Cited

U.S. PATENT DOCUMENTS 4,336,324 6/1982 Koboshi et al. ..... 430/372
4,548,899 10/1985 Nakayama et al. ..... 430/386
4,618,573 10/1986 Okamura et al. ..... 430/558
4,738,917 4/1988 Koboshi et al. ..... 430/386
4,804,617 2/1989 Nishikawa et al. ..... 430/386
4,914,007 4/1990 Fujita et al. ..... 430/387

FOREIGN PATENT DOCUMENTS 158446 8/1985 Japan .

OTHER PUBLICATIONS

P. Carlu, "Replenshiment of Solutions in Batch Processing," J. Phot. Sci., vol. 12, pp. 61-70, 1964.

*Primary Examiner*—Hoa Van Le
*Attorney, Agent, or Firm*—Burns, Doane, Swecker & Mathis

[57] ABSTRACT

This invention provides a processing method for an exposed silver halide color photographic material, which enables cut-down of the times required for bleaching-and-fixing and for washing and yet affords a stable image excellent in color reproduction. The processing method of this invention is characterized in that the silver halide color photographic material is developed with a color developing solution substantially free of benzyl alcohol, and that the thus developed photographic material is subjected to bleaching-and-fixing for a time of not more than 70 seconds and then subjected to washing for a time of not more than 70 seconds. Another important aspect of the invention resides in the use of a magenta coupler in the processing method with a merit that a stable colored image having excellent hue is developed without the fear of formation of stains although the times for the bleaching-and-fixing and for the washing are shortened remarkedly.

19 Claims, No Drawings

PROCESSING METHOD FOR SILVER HALIDE COLOR PHOTOGRAPHIC MATERIAL

This application is a continuation of application Ser. No. 005,893, filed Jan. 22, 1987, now abandoned.

BACKGROUND OF THE INVENTION

1. Field of the Invention

The present invention relates to a processing method for a silver halide color photographic material, and particularly to an improved method for enabling cut-down of the processing time after the color developing step. The present invention also resides in a color photographic material for affording a stable image excellent in color reproduction.

2. Prior Art

In general, the standard sequence for processing an exposed silver halide color photographic material includes the color developing step for developing a color image (about 3 minutes and 30 seconds), the bleach-fix (or blix) step for desilverizing (about 1 minute and 30 seconds) and the washing step for stabilizing the image (2 to 3 minutes).

However, there is an increasing demand for cutting down the processing time, as the time limit for delivery of the developed films or prints has been shortened up to date and for the alleviation of development operations is demanded.

Many investigations have been made to reduce the time required for color development. As a fruit of the investigations, it has been proposed to use a development accelerator, for example, by U.S. Pat. Nos. 2,950,970, 2,515,147, 2,496,963, 2,304,925, 4,038,075 and 4,119,462, British Patent Nos. 1,430,998 and 1,455,413, Unexamined Japanese Patent Publication Nos. 53-15831, 55-62450, 55-62451, 55-62452 and 55-62453, and Japanese Patent publication No. 51-12422 and 55-49728. Also proposed is the inclusion of a color developer agent, as disclosed in U.S. Pat. Nos. 3,719,492, 3,342,559 and 3,342,597 and Unexamined Japanese Patent Publication Nos. 56-6235, 56-16133, 57-97531 and 57-83565. Further proposed is the use of a silver chloride emulsion, as disclosed in Unexamined Japanese Patent Publication Nos. 58-95345, 59-232342 and 60-19140. It has been further proposed to raise the temperature of the color developer or the pH value thereof.

On the other hand, it has been proposed to cut down the time required for desilverizing step by the use of a combined bleaching and fixing bath in lieu of using two separate baths respectively for bleaching and fixing purposes. However, there is found few proposals for accelerating the bleaching-and-fixing step, and only a limited number of accerelators has been reported. As the examples of such accelerators, it may be mentioned to the compounds each having a mercapto group or a disulfide group, as disclosed in U.S. Pat. No. 3,893,858 and German Patent No. 1,290,812; the derivatives of thiourea as disclosed in U.S. Pat. No. 3,70,561 and Japanese Unexamined Patent Publication No. 53-32735; and the polyethyleneoxides as disclosed in German Patent No. 2,748,430. However, none of them can accerelate the bleaching-and-fixing step effectively to cut down the time required therefor satisfactorily.

In the conventional technology, it was impractical to set the time for bleaching-and-fixing to not more than 70 seconds since insufficient desilverization and insufficient color restoration were frequently resulted during the successive processing operations, the insufficient color restoration being led from the phenomenon that the cyan dyes were changed to leuco dyes.

Conventional measures for cutting down the time for washing include the addition of a chelating agent, foaming and vigorous agitation. However, satisfactory result has not been obtained by any of such measures. Particularly, the image preserving property is deteriorated if the time for washing is set to not more than 70 seconds. In addition to the deterioration in image preserving property, floating contaminants are left in the washing bath and adhere to the photographic material to cause failure or damages when the time for washing is shortened to not more than 70 seconds and the flow rate of washing water is descreased considerably. Although a variety of fading prevention agents is added to the conventional color photographic material with the aim to improving the image preserving property (see U.S. Pat. Nos. 2,816,028, 3,457,079, 3,698,909, 3,764,337 and 3,700,455), the fading prevention agent becomes ineffective as the time for the washing step is decreased to not more than 70 seconds.

Japanese Patent Un-examined Publication No. 60-158446 further discloses a method in which phenidone or its derivatives is incorporated in a color photographic material to conduct speedy development, and the color photographic material is developed with a developing solution containing not more than 2 ml/l of benzyl alcohol. In the specification of the publication, there is also described an embodiment in which such color photographic material is developed with a developing solution containing 1 ml/l of benzyl alcohol for one minute, bleached and fixed for one minute and washed for one minute. However, the above method is not sufficient in terms of prohibition of the increase of stains and stability of washing water.

On the other hand, the magenta coupler represented by the general formula (I) set forth hereinafter has a disadvantage that it tends to form magenta stains after the processing therewith through an ordinary process, although it has an advantage that dyes superior in hue are produced thereby. Particularly in case where the processing times for the bleaching-and-fixing step and for the washing step are cut down as is the case of the present invention, serious problems are resulted by the increase of stains. For this reason, the magenta coupler could not be used when speedy processing was required.

SUMMARY OF THE INVENTION

Accordingly, a primary object of this invention is to provide an improved processing method for a silver halide color photographic material, by which cut-down of the processing time after the color developing step can be realized.

Another object of this invention is to provide a processing method for a silver halide color photographic material for enabling the use of the magenta coupler to afford a stable image excellent in color reproduction and for ensuring stable color developing operation followed by shortened after-treatments with substantial cut-down of the times consumed for bleaching-and-fixing and washing steps.

With the aforementioned objects in view, the present invention provides a processing method for an exposed silver halide color photographic material, which comprises the steps of: color developing said silver halide color photographic material with a color developing solution substantially free of benzyl alcohol; subjecting said silver halide color photographic material to bleaching-and-fixing for not more than 70 seconds; and washing said silver halide color photographic material with water for not more than 70 seconds.

In a preferred embodiment of this invention the silver halide color photographic material contains a magenta coupler represented by the following general formula (I) of:

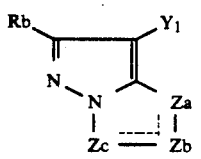

(I)

wherein Rb is a hydrogen atom or a substituent; $Y_1$ is a group capable of being eliminated by the coupling reaction with the oxidized product of an aromatic primary amine developing agent; Za, Zb and Zc each represents methine group, a substituted methine group, =N— or —NH—; and either one of the Za-Zb bond or the Zb-Zc bond is a double bond with the other being a single bond.

It is a surprising finding that a color developing solution can be formulated easily and the tank for color development of the processing system is kept clean with little stain only by removing benzyl alcohol from the color developing solution. In addition, the number of stains adhering to the processed photographic material is decreased. Occurrence of magenta stain, otherwise caused in the conventional process, has been also prevented, and a stable image excellent in hue can be obtained.

The other objects, features and advantages of this invention will become apparent from the following detailed description.

DESCRIPTION OF PREFERRED EMBODIMENTS

The processing steps included in the method of this invention will now be described in detail.

In this invention, the time for color developing step ranges generally from 30 seconds to 3 minutes and 30 seconds, preferably from 45 seconds to 2 minutes and 30 seconds. It is preferred that the time for color development should be as short as possible as far as sufficient optical density of color is obtained.

The color developing solution used in the developing step in the method of this invention is an aqueous alkali solution preferably containing an aromatic primary amine color developing agent. Preferable color developing agents are p-phenylenediamine base compounds, the typical examples being 3-methyl-4-amino-N,N-diethylaniline, 3-methyl-4-amino-N-ethyl-N-β-hydroxyethylaniline 3-methyl-4-amino-N-ethyl-β-methansulfonamidoethylaniline, 3-methyl-4-amino-N-ethyl-N-β-methoxyethylaniline, and sulfates, hydrochlorides, phosphates, p-toluenesulfonates, tetraphenylborates and p-(t-octyl)benzenesulfonates thereof.

Derivatives of aminophenol may be used, the examples being o-aminophenol, p-aminophenol, 4-amino-2-methylphenol, 2-amino-3-methylphenol, 2-amino-3-methylphenol and 2-oxy-3-amino-1,4-dimethyl-benzene.

Other examples of the color developing agent which may be used in this invention are those disclosed in L. F. A. Mason, "Photographic Processing Chemistry", Focal Press, pages 226 to 229, U.S. Pat. Nos. 2,193,015 and 2,592,364 and Unexamined Japanese Patent Publication No. 48-64933. Two or more of color developing agents may be combined, if necessary.

The temperature of the color developing solution ranges preferably from 30° C. to 50° C., more preferably from 33° C. to 45° C.

Although benzyl alcohol should not be contained in the color developing solution in the present invention, a variety of other known development accerelators may be used. Examples of the development accerelator which may be used in this invention are various pyrimidium compounds and other cationic compounds, for example, disclosed in U.S. Pat. No. 2,648,604, Japanese Patent publication No. 44-9503 and U.S. Pat. No. 3,171,247; cationic dyes such as Phenosafranine; neutral salts such as thallium nitrate; polyethyleneglycol and derivatives thereof as disclosed in Japanese Patent publication No. 44-9304 and U.S. Pat. Nos. 2,533,990, 2,531,832, 2,950,970 and 2,577,127; nonionic compounds such as polythioethers; thioether base compounds disclosed in U.S. Pat. No. 3,201,242; and other compounds such as those disclosed in unexamined Japanese Patent Publication No. 58-156934.

The wordings "substantially free of benzyl alcohol", "substantially does not contain benzyl alcohol" or "substantially no benzyl alcohol" or like expressions used throughout the specification and claims mean that the concentration of benzyl alcohol in the color developing solution is not more than 0.5 ml/l, and preferably the color developing solution contains no benzyl alcohol.

Preferred antifoggants used in the color developing step are halides of alkali metals, such as potassium bromide, sodium chloride and potassium iodide, and organic antifoggants. Examples of the organic antifoggant are nitrogen-containing hetero-cyclic compounds, such as benzotriazole, 6-nitrobenzimidazole, 5-nitroisoindazole, 5-methylbenzotriazole, 5-nitrobenzotriazole, 2-thiazolylbenzimidazole, 2-thiazolylmethyl-benzimidazole, adenine and hydroxyazaindolizine; merecapto substituted hetero-cyclic compounds, such as 1-phenyl-5-mercaptotetrazole, 2-mercaptobenzimidazole and 2-mercaptobenzothiazole; and mercapto-substituted aromatic compounds, such as thiosalicylic acid. Halides are particularly preferred antifoggants. These antifoggants may be eluted from the photographic material under processing so that they are accumulated in the color developing solution.

Other ingredients which may be contained in the color developing solution used in this invention include a pH buffer such as carbonates, borates or phosphates of alkali metals; a preservative such as hydroxylamines, triethanolamine, compounds disclosed in German OLS No. 2,622,950, sulfites or bisulfites; an organic solvent such as diethylene glycol; a dye-forming coupler; competing coupler; nucleus-forming agent such as sodium boron hydride; an auxiliary developer such as 1-phenyl-3-pyrozolidones; a viscosity increasing agent or thickner; and a chelating agent including aminocarboxylic acids such as ethylenediamine tetraacetic acid, nitrilotriacetic acid, cyclohexanediamine tetraacetic acid, imminodiacetic acid, N-hydroxymethylethylenediamine triacetic acid, diethylenetriamine pentaacetic acid, triethylenetetramine hexaacetic acid, and compounds disclosed in Unexamined Japanese Patent publication No. 58-195845, organic phosphonic acids such as 1-hydroxyethylidene-1,1'-diphosphonic acid and those disclosed in Research Disclosure No. 18170 (May, 1979), aminophosphonic acids such as aminotris(-methylenephosphonic acid) and ethylenediamine-N,N,N',N'-tetramethylenephosphonic acid, and phosphonocarboxylic acids such as those disclosed in Unexamined Japanese Patent Publication Nos. 52-102726, 53-42730, 54-121127, 55-4024, 55-4025, 55-126241, 55-65955 and 55-65956 and those disclosed in Research Disclosure No. 18710 (May, 1979).

The color developing bath may be divided into two or more baths, if necessary, and the color developing solution may be replenished from the first or the last bath to shorten the time required for development or to decrease the quantity of replenished solution.

In the method of this invention, the developed silver is subjected to bleaching and fixing after the completion of color development. According to one important feature of this invention, bleaching-and-fixing is completed within a short time of not more than 70 seconds, preferably not more than one minute, more preferably within 20 seconds to one minute.

Examples of the bleaching agent which may be used in this step are organic complexes of iron(III) or cobalt(III), such as complexes of iron(III) or cobalt (III) with aminopolycarboxylic acids (e.g. ethylenediamine tetraacetic acid and diethylenetriamine pentaacetic acid), aminopolyphosphonic acids, phosphonocarboxylic acids and organic phosphonic acids; organic acids such as citric acid, tartaric acid and malic acid; persulfates; and hydrogen peroxide. Among the bleaching agents set forth above, it may be mentioned that the organic complexes of iron(III) are preferred for rapid processing and for prevention of pollution of environment. Examples of the aminopolycarboxylic acids, aminopolyphosphonic acids or salts thereof, which are usable for forming organic complexes of iron (III), will be set forth below.

Ethylenediamine Tetraacetic Acid;
Ethylenetriamine Pentaacetic Acid;
Ethylenediamine-N-(β-oxyethyl)-N,N',N'-triacetic Acid;
1,3-Diaminopropane Tetraacetic Acid;
Triethylenetetramine Hexaacetic Acid;
Propylenediamine Tetraacetic Acid;
Nitrilo-Triacetic Acid;
Nitrilo-tripropionic Acid;
Cyclohexanediamine Tetraacetic Acid;
1,3-Diamino-2-propanol Tetraacetic Acid;
Methyliminodiacetic Acid;
Iminodiacetic Acid;
Hydroxyiminodiacetic Acid;
Dihydroxyethylglycineethyletherdiamine Tetraacetic Acid;
Glycoletherdiamine Tetraacetic Acid;
Ethylenediamine Tetrapropionic Acid;
Ethylenediaminedipropionacetic Acid;
Phenylenediamine Tetraacetic Acid;
2-Phosphonobutane-1,2-4-triacetic Acid;
1,3-diaminopropanol-N,N,N',N'-tetramethylenephosphonic Acid;
Ethylenediamine-N,N,N',N'-tetramethylenephosphonic Acid;
1,3-Propylenediamine-N,N,N',N'-tetramethylenephosphonic Acid;
1-Hydroxyethylidene-1,1'-diphosphonic Acid.

Among the compounds set forth hereinabove, complexes of iron(III) of ethylenediamine tetraacetic acid, diethylenetriamine pentaacetic acid, propylenediamine tetraacetic acid, cyclohexanediamine tetraacetic acid, 1,3-diaminopropane tetraacetic acid and methyliminodiacetic acid are preferred, since they have intensive bleaching power.

One or more of prepared complexes may be used as the iron(III) complexes; or one or more salts of iron (III) (e.g. ferric sulfate, ferric chloride, ferric nitrate, ammonium ferric sulfate, ferric phosphate) are reacted with one or more of chelating agents (e.g. aminopolycarboxylic acids, aminopolyphosphonic acids, phosphonocarboxylic acids) in the solution to produce ferric ion complexes. When complexes are produced in the solution, either one or both of the ferric salt and/or chelating agent may be mixtures of two or more ingredients. Irrespective of either the complex is a prepared complex or the complex is produced in the solution, the chelating agent may be used in an amount of more than the stoichiometric amount. The bleaching solution or the bleaching-and-fixing solution containing the aforementioned one or more ferric ion complexes may be added with other metal ions, such as cobalt or copper ions, and/or complexes thereof, or may be added with hydrogen peroxide.

The content of the bleaching agent per one liter of the bleaching-and-fixing solution ranges generally from 0.075 to 2.0 mols, preferably from 0.1 to 0.5 mols.

The fixing agent used in this invention is a water-soluble solubilizer for silver halides and may be selected from known fixing agents. The examples of the usable fixing agent include thiosulfates such as sodium thiosulfate and ammonium thiosulfate; thiocyanates such as sodium thiocyanate and ammonium thiocyanate; thioether compounds such as ethylenebisthioglycollic acid and 3,6-dithia-1,8-octanediol; and thioureas. One or a mixture of two or more of the fixing agents may be used. In the bleaching-and-fixing step, special bleaching-and-fixing agents each comprised of a combination of a fixing agent with a halide, such as potassium iodide, as described in Unexamined Japanese Patent Publication No. 55-155354, may also be used. Thiosulfates, particularly ammonium salts of thiosulfuric acid, are preferably used in the present invention.

Preferably from 0.3 to 3 mols, more preferably from 0.5 to 1.5 mols, of fixing agent is contained in one liter of the bleaching-and-fixing solution.

Preferable pH range of the bleaching-and-fixing solution used in this invention is 4 to 9, and particularly preferred range is 5 to 7.5. If the solution has a pH value of lower than the aforementioned range, exhaustion of the solution is accerelated and cyan dyes tend to become leuco dyes although the desilverization power or capability is increased. On the contrary, if the pH value of the solution is higher than the aforementioned range, desilverization is retarded with detrimental inclination for the formation of stains.

In order to adjust the pH value of the solution, hydrochloric acid, sulfuric acid, nitric acid, acetic acid, a bicarbonate, ammonia, caustic potash, caustic soda, sodium carbonate or potassium carbonate may be added. In consideration of the desilverization, acetic acid and ammonia are particularly preferred.

As an additional ingredient, the bleaching-and-fixing solution used in this invention may contain a rehalogenating agent such as bromides (e.g. potassium bromide, sodium bromide and ammonium bromide), chlorides (e.g. potassium chloride, sodium chloride and ammonium chloride) or iodides (e.g. ammonium iodide). Optional additives which may be added, as desired, include one or more inorganic acids, organic acids and salts thereof with alkali metals or ammonium having pH buffering effects, such as borax, sodium metaborate, acetic acid, sodium acetate, sodium carbonate, potassium carbonate, phosphorous acid, phosphoric acid, sodium phosphate, citric acid, sodium citrate and tartaric acid; and an anticorrosive such as ammonium nitrate and guanidine.

Other than the aforementioned additives which may be optionally added to the bleaching-and-fixing solution, a perservative may be added. The perservative may be selected, for example, from sulfites such as sodium sulfite, potassium sulfite and ammonium sulfite, bisulfites, hydroxylamines, hydrazine and bisulfite adducts of aldehyde compounds such as sodium acetoaldehyde bisulfite. Examples of still further additives which may be contained in the bleaching-and-fixing solution are various fluorescent brightening agents, defoaming agents or surfactants, and organic solvents such as polyvinyl pyrrolidone and methanol.

A bleaching accerelator may be used in the bleaching-and-fixing solution or in a bath preceding to the bleaching-and-fixing bath. Specific examples of usable bleaching accerelator are disclosed in the prior patent specifications listed hereinbelow. Namely, examples of bleaching accerelator are compounds having mercapto or disulfide groups such as those disclosed in U.S. Pat. No. 3,893,858, German Patent Nos. 1,290,812 and 2,059,988, Unexamined Japanese Patent publication Nos. 53-32736, 53-57831, 53-37418, 53-65732, 53-72623, 53-95630, 53-95631, 53-104232, 53-124424, 53-141623 and 53-28426, and Research Disclosure No. 17129 (July, 1978); thiazolidine derivatives described in Unexamined Japanese Patent Publication No. 50-140129; derivatives of thiourea such as those disclosed in Japanese Patent publication No. 45-8506, Japanese Unexamined Patent publication Nos. 52-20832 and 53-32735, and U.S. Pat. No. 3,706,561; iodides disclosed in German Patent No. 1,127,715 and Unexamined Japanese Patent Publication No. 58-16235; polyethyleneoxides disclosed in German Patent Nos. 966,410 and 2,748,430; polyamine compounds described in Japanese Patent Publication No. 45-8836; and other compounds and iodine and bromine ions as disclosed in Unexamined Japanese Patent publication Nos. 49-42434, 49-59644, 53-94927, 54-35727, 55-26506 and 58-163940. Preferable accerelators are the compounds each having a mercapto or disulfide group since they have more intense accerelating effect, particularly preferred being the compounds disclosed in U.S. Pat. No. 3,893,858, German Patent No. 1,290,812 and Unexamined Japanese Patent publication No. 53-95630.

In the processing method of this invention, the supply rate or quantity of the bleaching-and-fixing solution replenished into the bleaching-and-fixing bath may be freely controlled, and it is recommended that the amount of replenishing solution is about 0.5 to 100 times, preferably 1 to 10 times, by weight, of the solution entrained by the photographic material to be fed from the preceding bath into the bleaching-and-fixing bath.

After the completion of bleach-and-fix processing, the photographic material is washed with water. According to the present invention, the ordinary "washing step" may be replaced by a simpler processing, such as a so-called "stabilizing step". That is, according to one embodiment of this invention, the substantial washing step is dispensed with and the stabilization of the image is achieved only by the "stabilizing step" to form a stable image which is more stable than the one which has been processed through the conventional washing step. Thus, it should be noted hereby that the "washing step" or "washing treatment" as used in this specification has a broad concept or extension to include such a simplified processing.

The time for the washing step in the method of this invention is not more than 70 seconds, preferably from 30 seconds to one minute. The washing time is defined to indicate the time during which the photographic material is substantially contacting with an aqueous solution or water for washing in a broad sense, the time for transportation when the photographic material is moved in air being excluded from the washing time. In other words, the "washing time" does not mean all of the period from the time at which the photographic material begins to contact with the washing solution or water to the time at which the photographic material reaches the final drying zone. In case where the so-called "stabilization" or "stabilizing process" is empolyed in lieu of the ordinary washing with water, the definition as described hereinabove should be applied so that the washing or stabilizing time means the time period over which the photographic material is contacting with the stabilizer.

It is difficult to define the quantity of aqueous solution used in the washing step, as referred to in a broad sense, since it is varied depending on the number of multi-stage counter-flow washing baths and the quantity of and also depending on the carry-over liquid drawn from the preceding bath. However, in the present invention, it suffices that the content of ingredients of the bleaching-and-fixing solution in the final washing bath is less than $1\times10^{-4}$. For instance, when washing is effected by a simple washing with water in a three tank counter-flow system, it is preferred that about 1000 ml or more, more preferably not less than 5000 ml, of washing solution is used to wash 1 $m^2$ of the photographic material processes in the bath. When washing is effected in a water-saving process, it is recommendable to replenish the washing solution in an amount of 0.1 to 50 times, preferably from 1 to 10 times, of the weight of the bleaching-and-fixing solution carried over into the first washing bath (i.e. the volume of the aqueous washing solution amounting to 100 to 1000 ml per 1 $m^2$ of the photographic material processed in the bath).

Washing is effected at a temperature of within 15° C. to 45° C., preferably from 20° C. to 35° C.

Various known compounds may be used in this washing step to be used as the additives for preventing formation of precipitates or for stabilizing the aqueous washing solution. Examples of such additives, which may be added as necessity arises, are chelating agents such as inorganic phosphoric acid, aminocarboxylic acids or organic phosphonic acids; various germicides and antifugal agents for the prevention of growth of bacteria, algae or fungi, such as the compounds listed in "J. Antibact. Antifung. Agents", vol 11, No. 5, pages 207 to 223 (1983) and Horoshi Horiguchi, "Chemistry of Protection from Bacteria and Fungi" (BOKIN BOKUN NO KAGAKU"); salts of metals, alkali metal and ammonium represented by magnesium salts and ammonium salts; and surfactants for decreasing load and for preventing uneven drying at the drying step. Optionally, the compounds reported by West, "Phot. Sci. Eng.", vol 6, pages 344 to 359 (1965) may also be added.

The present invention provides particular effects in case where the aqueous washing solution is added with a chelating agent, a germicide and/or an antifungal agent and washing is carried out in a multi-stage counter-flow system having more than two baths to save considerable amount of washing water. A particular effect can also be provided when a multi-stage counter-flow stabilization processing (a so-called stabilizing treatment) is adopted in lieu of the ordinary washing step. In either case, it suffices to control the content of the ingredients of the bleaching-and-fixing solution left in the final bath in the range of not more than $5\times10^{-2}$, preferably not more than $1\times10^{-2}$.

The stabilizing bath used after the washing step, such stabilizer bath being preferably used in lieu of the washing bath, may be added with various compounds for stabilizing the image. Representative examples of such additives are various buffer compositions (e.g. combinations of borates, metaborates, bolax, phosphates, carbonates, potassium hydroxide, sodium hydroxide, aqueous ammonia, monocarboxylic acids, dicarboxylic acids and polycarboxylic acids), and aldehydes such as formalin. Other additives which may be contained in the stabilizing bath include chelating agents such as inorganic phosphoric acid, aminocarboxylic acids, organic phosphonic acids, aminopolyphosphonic acids and phosphonocarboxylic acids; germicides such as thiazole base germicides, isothiazole base germicides, halogenated phenols and benzotriazol; surfactants; fluorescent brightening agents; and hardeners. Two or more compounds may be used for the same or different purposes.

In order to improve the durability of image it is preferable to add a variety of ammonium salts for serving as a pH adjuster for the processed membrane, the examples of ammonium salts usable for such a purpose being ammonium chloride, ammonium nitrate, ammonium sulfate, ammonium phosphate, ammonium sulfite and ammonium thiosulfate.

During the successive operations in this invention, the quantity of the finished products can be maintained at a constant level by feeding adequate replenishers to the respective processing solutions to prevent change in compositions of the processing solutions. For the purpose of cost down, the quantity of each of the replenishing solutions can be reduced to a half, or even less than half, of the standard quantity of each replenisher.

Each processing bath may be optionally provided with a heater, a thermosensor, a liquid level sensor, a recirculation pump, a filter, a variety of floating covers and/or a variety of squeezees, or may be agitated by nitrogen or air blowing.

The magenta couplers represented by the general formula (I) will now be described in detail.

In the general formula (I), Rb represents a hydrogen atom or a substituent; $Y_1$ represents a group capable of being eliminated by the coupling reaction with the oxidized product of an aromatic amine developing agent; Za, Zb and Zc each represents a methine group, a substituted methine group, —N— or —NH—; and either one of the Zb-Zb bond or the Zb-Zc bond is a double bond with the other being a single bond. When the Zb-Zc bond is a carbon-carbon double bond, the bond may be a portion of an aromatic ring. A dimer or polymer may be formed by the group Rb or $Y_1$. When Za, Zb or Zc is a substituted methine, the substituted methine may be a dimer or polymer.

In the general formula (I), a polymer means the coupler having two or more groups represented by the general formula (I), and include bis-compounds, oligomers and polymer couplers. The polymer couplers may be a homopolymer of a monomer (preferably having a vinyl group, and hereinafter referred to as "vinyl monomer") in which a portion represented by the general formula (I) is included, or may be a copolymer thereof with an uncoupling ethylenic monomer which is not coupled with the oxidized product of an aromatic primary amine.

Each of the compounds repesented by the general formula (I) is a nitrogen-containing heterocyclic coupler produced by condensation of a five-member ring and another five-member ring, and the coupling nuclei thereof shows the aromatic inherency isoelectronic with naphthalene, with the chemical structure thereof being that generally referred to as azapentalene. Of the couplers represented by the general formula (I), the following are preferred compounds:

1H-imidazo(1, 2-b)pyrazoles,
1H-pyrazolo(1, 5-b)pyrazoles,
1H-pyrazolo(5, 1-c)(1,2,4)triazoles,
1H-pyrazolo(1, 5-b)(1,2,4)triazoles,
1H-pyrazolo(1, 5-d)tetrazoles, and
1H-pyrazolo(1, 5-a)benzimidazoles.

The preferred compounds set forth above are represented, respectively, by the following general formulae (II), (III), (IV), (V), (VI) and (VII). The particularly preferred compounds are those represented by the general formulae (IV) and (V).

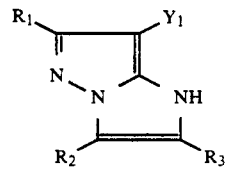

[II]

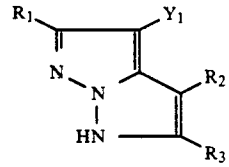

[III]

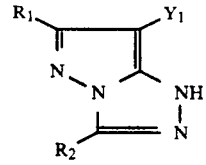

[IV]

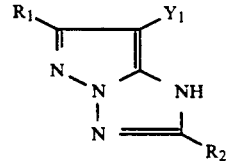

[V]

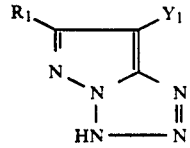

[VI]

-continued

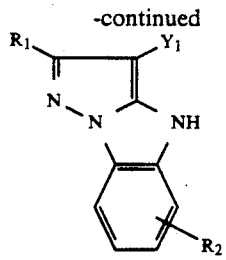

[VII]

The substituents $R_1$, $R_2$ and $R_3$ in the general formulae (II) to (VII) each represents a hydrogen atom, a halogen atom, an alkyl group, an aryl group, a heterocyclic group, a cyano group, an alkoxy group, an aryloxy group, a heterocyclia oxy group, an acyloxy group, a carbamoyloxy group, a silyloxy group, a a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, alkoxycarbonyl group and aryloxycarbonyl group; and $Y_1$ represents a hydrogen atom, a halogen atom, a carboxyl group or a group combined with the carbon at the coupling site through an oxygen, nitrogen or sulfur atom to be released upon coupling.

$R_1$, $R_2$, $R_3$ or $Y_1$ may be a difunctional group, which might form a bis-compound. When the portion represented by any of the general formulae (II) to (VII) is included in a vinyl monomer, $R_1$, $R_2$ or $R_3$ stands for a bond or a binding group through which the vinyl group is bonded with the portion represented by any of the general formulae (II) to (VII).

More specifically, examples of $R_1$, $R_2$ and $R_3$ are: a hydrogen atom; a halogen atom (e.g. a chlorine atom, a bromine atom, etc.); an alkyl group (e.g. a methyl group, a propyl group, a t-butyl group, a trifluoromethyl group, a tridodecyl group, a 3 (2,4-di-t-anylphenoxy)propyl group, an aryl group, a 2-dodecyloxyethyl group, a 3-phenoxypropyl group, a 2-hexylsulfonyl-ethyl group, a cyclopentyl group, a benzyl group, etc.); an aryl group, (e.g. a phenyl group, a 4-butylphenyl group, 1 2,4-diamylphenyl group, a 4-tetradecaneamidophenyl group, etc.); a heterocyclic group (e.g. a 2-furyl group, a 2-thienyl group, a 2-pyrimidinyl group, a 2-benzothioazoyl group, etc.); a cyano group; an alkoxy group (e.g. a methoxy group, an ethoxy group, a 2-methoxyethoxy group, a 2-dodecyloxyethoxy group, a 2-methanesulfonylethoxy group, etc.); an aryloxy group (e.g. a phenoxy group, a 2-methylphenoxy group, a 4-t-butylphenoxy group, et.); a heterocyclic oxy group (e.g. a 2-benzimidazolyloxy group, etc.); an acryloxy group (e.g. an acetoxy group, a hexadecanoyloxy group, etc.); a carbamoyloxy group (e.g. an N-phenylcarbamoyloxy group), an N-ethylcarbamoyloxy group, etc.); a silyloxy group (e.g. a trimethylsilyloxy group, etc.); a sulfonyloxy group (e.g. a dodecylsulfonyloxy group, etc.); an acylamino group (e.g. an acetamido group, a benzamido group, a tetradecaneamido group, an -(2,4-di-t-amylphenoxy)-butylamido group, -(3-t-butyl-4-hydrophenoxy)-butylamido group, an -(4-(4-hydroxyphenylsulfonyl)-phenoxy)decaneamido group, et.c0; an anilino group (e.g. a phenylamino group, a 2-chloroanilino group), a 2-chloro-5-tetradecaneamidoanilino group, a 2-chloro-5-dodecyloxycarbonylanilino group, an N-acetylanilino group, a 2-chloro-5-(-(3-t-butyl-4-hydroxyphenoxy)-dodecaneamido)anilino group etc.); a ureido group (e.g. a phenylureido group, a methyl ureido group, etc.); an N,N-dibutylureido group, etc.); an imido group (e.g. an N-succinimido group, a 3-benzylhydantoinyl group, a 4-(2-ethylhexanoylamino)phtalimido group, etc.); a sulfamoylamino group (e.g. an N,N-dipropylaulfamoylamino group, an N-methyl-N-decylsulfamoylamino group, etc.); an alkylthio group (e.g. a methylthio group, an octylthio group, a tetradecylthio group, a 2-phenoxyethylthio group, a 3-phenoxypropylthio group, a 3-(4-t-butylphenoxy)propylthio group, etc); an arylthio group (e.g. a phenylthio group, a 2-carboxyphenylthio group, a 4-tetradecaneamidopheylthio group, etc.); a heterocyclic thio group (e.g. a 2-benzothiazoylthio group, etc.); an alkoxycarbonylamino group, a tetradecyloxycarbonylamino group, etc.); an aryloxycarbonylamino group (e.g. a phenoxycarbonyl amino group, a 3,4-di-tert-butylphenoxycarbonylamido group, et.); a hexadecanesulfonamido group, benzenesulfonamido group, a p-toluenesulfonamido group, an octadecanesulfonamido group, a 2-methyloxy-5-t-butylbenzenesulfonamido group, etc.); a carbamoyl group (e.g. an N-ethylcarbamoyl group, an N,N-dibutylcarbamoyl group, an N-(2-dodecyloxyethyl)carbamoyl group, an N-methyl-N-dodecylcarbamoyl group, an N-(3-(2,4-ditert-amylphenoxy)propyl)carbamoyl group, etc.); an acyl group (e.g. an acetyl group, a (2,4-di-tert-amylphenoxy)acetyl group, a benzoyl group, etc.); a sulfamoyl group (e.g. an N-ethylsulfamoyl group, an N,N-dipropylsulfamoyl group, an N-(2-decyloxyethyl)-sulfamoyl group, an N-ethyl-N-dodecylsulfamoyl group, an N,N-diethylsulfamoyl group, etc.); a sulfonyl group (e.g. a methanesulfonyl group, an octanesulfonyl group, a benzenesulfonyl group, a toluenesulfonyl group, etc.); a sulfinyl group (e.g. an octanesulfinyl group, a dodecylsulfinyl group, a phenylsulfinyl group, etc.); an alkoxycarbonyl group (e.g. a methoxycarbonyl group, a butyloxycarbonyl group, a decylcarbonyl group, an octadecylcarbonyl group, etc.); and an aryloxycarbonyl group (e.g. a phenyloxycarbonyl group, a 3-pentadecyloxy-carbonyl group, etc.) Specific examples of X are: a hydrogen atom; a halogen atom (e.g. a chlorine atom, a bromine atom, an iodine atom, etc.); a carboxyl group or a group linked through an oxygen atom (e.g. an acetoxy group, a propanoyloxy group, a benzoyloxy group, a 2,4-dichlorobenzoyloxy group, an ethoxyoxaloyloxy group, a pyryvinyloxy group, cinnamoyloxy group, a phenoxy group, a 4-cyanophenoxy group, a 4-methanesulfonamidephenoxy group, a 4-methanesulfonylphenoxy group, an $\alpha$-naphtoxy group, a 3-pentadecylphenoxy group, a benzyloxycarbonyloxy group, an ethoxy group, a 2-cyanoethoxy group, a benzyloxyy group, a 2-phenetyloxy group, a 2-phenoxyethoxy group, a 5-phenyltetrazoyloxy group, a 2-benzothiazoryloxy group); a group linked through a nitrogen atom (e.g. a benzenesulfoneamido group, an N-ethyltoluenesulfoneamido group, a heptafluorobutaneamido group, a 2,3,4,5,6-pentafluorobenzamido group, an octanesulfoneamido group, a p-cyanophenylureido group, an N,N-diethylsulfamoylamino group, 1-pyperidyl group, 5,5-dimethyl-2,4-dioxo-3-oxazolizinyl group, a 1-benzyl-ethoxy-3-hydantoinyl group, a 2N-1,1-dioxo-3-(2H)-oxo-1,2-benzoisothiazoryl group, a 2-oxo-1,2-dihydro-1-pyridinyl group, an imidazoryl group, a pyrazoyl group, a 3,5-diethyl-1,2,4-triazole-1-yl group, a 5- or6-bromo-benzotriazole-1-yl, a 5-methyl-1,2,3,4-triazole-1-yl group, a benzimidazoryl group, a 3-benzyl-1-hexadecyloxy-3-hydantoinyl group, a 5-methyl-1-tetrazoryl group, 4-methoxyphenylazo group, a 4-pivaloylaminophenylazo group, 2-hydroxy-4-propanoylphenylazo group, etc.); a group linked through a sulfur atom (e.g. a phenylthio group, 2-carboxyphenylthio group, 2-methoxy-5-t-octylphenylthio group, 4-methanesulfonylphenylthio group, a 4-octanesulfoneamidophenylthio group, 2-butoxyphenylthio group, 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazorylthio group, a 2-benzothiazorylthio group, a 2-dodecylthio-5-thiophenylthio group, a 2-phenyl-3-dodecyl-1,2,4-triazoyl-5-thio group, etc.)

When $R_1$, $R_2$, $R_3$ or $Y_1$ is a difunctional group to form a bis-compound, examples of such a difunctional group are: a substituted or unsubstituted alkylene group (e.g. a methylene group, an ethylene group, a 1,10-decylene group, $—CH_2CH_2—O—CH_2CH_2—$, etc.); a substituted or unsubstituted phenylene group (e.g. a 1,4-phenylene group, 1,3-phenylene group,

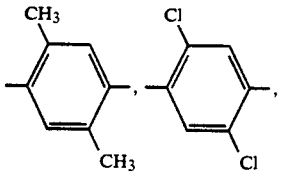

etc.); and —NHCO—$R_7$ or —CONH— group (wherein $R_7$ is a substituted or unsubstituted alkylene group or a phenylene group).

When the portion represented by any of the general formulae (II) to (VII) is included in a vinyl monomer, the linking group represented by $R_1$, $R_2$ or $R_3$ includes those which are formed by the combination of the following groups of: an alylene group (e.g. a substituted or unsubstituted alkylene group, such as a methylene group, an ethylene group, a 1,10-decylene group, $—CH_2CH_2OCH_2CH_2—$, etc.); a phenylene group (a substituted or unsubstituted phenylene group, such as a 1,4-phenylene group, a 1,3-phenylene group,

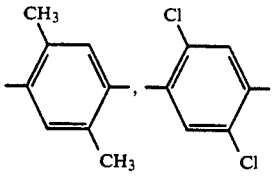

etc.); —NHCO—, —CONH, —O—, —OCO— and an aralkylene group (e.g.

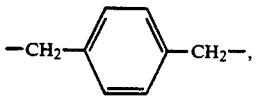

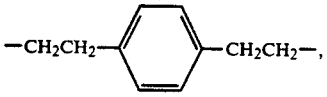

-continued

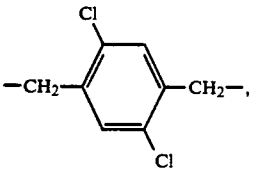

Meanwhile, the vinyl group in the vinyl monomer includes those each having a substituent group, other than those represented by any of the general formulae (II) to (VII). Examples of preferred substituent are a hydrogen atom, a chlorine atom and a lower alkyl group each having 1 to 4 carbon atoms.

Examples of the uncoupling ethylenic monomer which does not couple with the oxidants of the aromatic primary amine developing agent are: acrylic acid; α-chloroacrylic acid; α-alkylacrylic acid (e.g. methacrylic acid, etc.); and ester or amide derived from these acrylic acids (e.g. acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy methacrylate); methylenebisacrylamides and vinyl esters (e.g. vinyl acetate, vinyl propionate, vinyl laurate, etc.); acrylonitrile; mathacrylnitrile; aromatic vinyl compounds (e.g. styrene and its derivatives, vinyltoluene, divinylbenzene, vinylacetophenone, sulfosutyrene, etc.); itaconic acid; citraconic acid; crotonic acid; vinylidene chloride; vinyl alkyl ethers (e.g. vinyl ethyl ether); maleic acid; maleic anhydride; maleates; N-vinyl-2-pyrrolidone; N-vinylpyrrolidone; and 2- and 4-vinylpyridine. Two or more of uncoupling ethylenically unsaturated monomers may be in combination.

Of the couplers of the formulae (II) to (VII), the couplers of the formulae (II), (IV) and to (V) are preferable and the coupler of the formula (V) is the most preferable. In these formulae (IV) and (V), at least one of $R_1$ and $R_2$ are preferably a branched substituted or unsubstituted alkyl group, that is an alkyl group or a substituted alkyl group which is connected to a pyrazoloazole skeleton through a secondary or tertiary carbon atom, wherein a secondary carbon atom means a carbon atom to which only one hydrogen atom is directly connected, and a tertiary carbon atom means a carbon atom to which no hydrogen atom but preferably an alkyl group or a substituted alkyl group is directly connected. The examples of the substituted alkyl group are a sulfonamido alkyl group, a sulfonamidoarylalkyl group, a sulfonyl alkyl group and the like, wherein a sulfonamidoarylsulfonamido alkyl group is preferable as a sulfonamidoalkyl group.

Examples of the coupler compounds, which is represented by the general formulae (II) to (VII) and processes for the synthesis thereof, are described in the following publications.

The compounds represented by the general formula (II) are described, for example, in Unexamined Japanese Patent Publication No. 59-162548; the compounds represented by the general formula (III) are described, for example, in Unexamined Japanese Patent Publication No. 60-43659; the compounds represented by the general formula (IV) are described, for example, in Japanese Patent Publication No. 47-27411; the compounds represented by the general formula (V) are described, for example, Unexamined Japanese Patent Publication No. 59-171956 and Japanese Patent Application No. 59-27745; the compounds represented by the general formula (VI) are described, for example, in Unexamined Japanese Patent Publication No. 60-333552; and the compounds represented by the general formula (II) are described, for example, in U.S. Pat. No. 3,061,432.

Any of the compounds represented by the general formulae (I) to (VII) set forth above may be applied with a highly sensitive coloring ballast group described, for example, in Unexamined Japanese Patent publication Nos. 58-42045, 59-214854, 59-177553, 59-177554 and 59-177557.

Specific examples of the pyrazoloazole base couplers used in this invention will be set forth below. However, it should be noted here that the following are illustrated by way of example only, and should not be interpreted in a limiting sense.

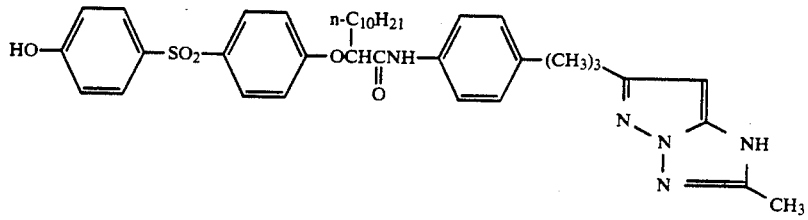

(M-1)

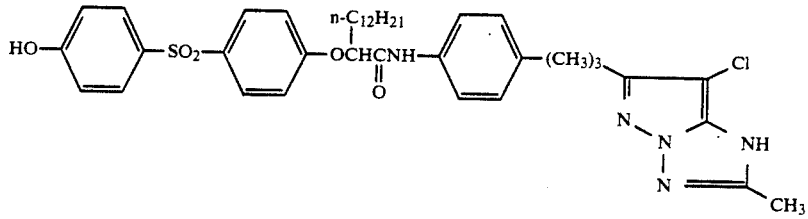

(M-2)

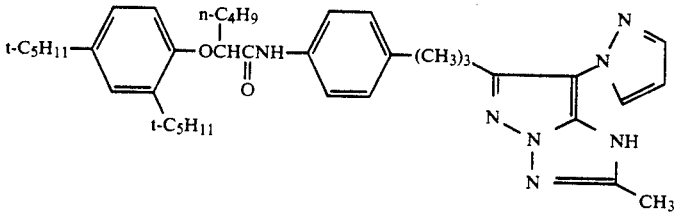

(M-3)

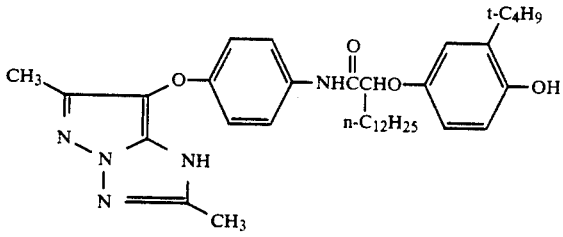

(M-4)

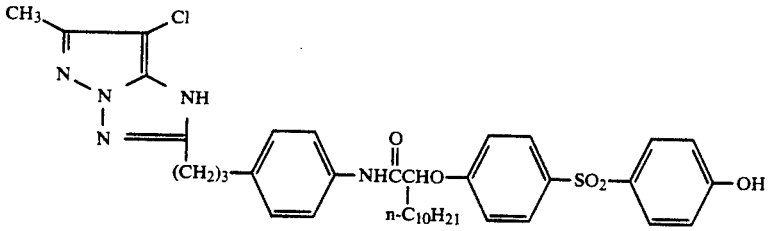

(M-5)

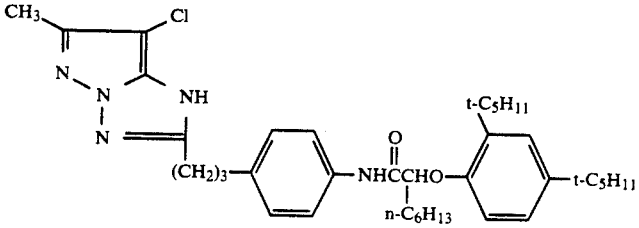

(M-6)

-continued
(M-7)
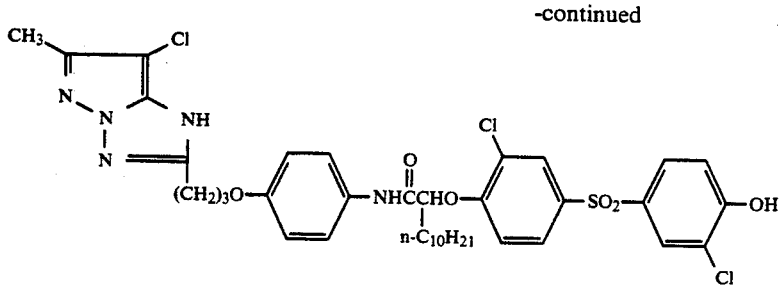
(M-8)
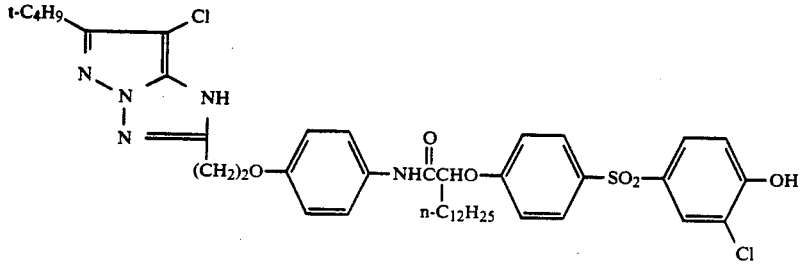
(M-9)
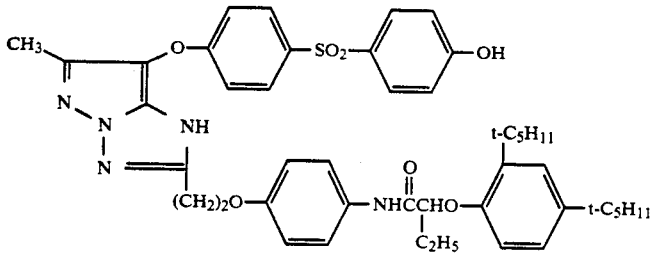
(M-10)
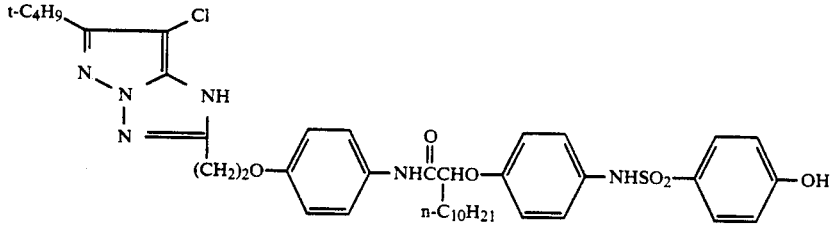
(M-11)
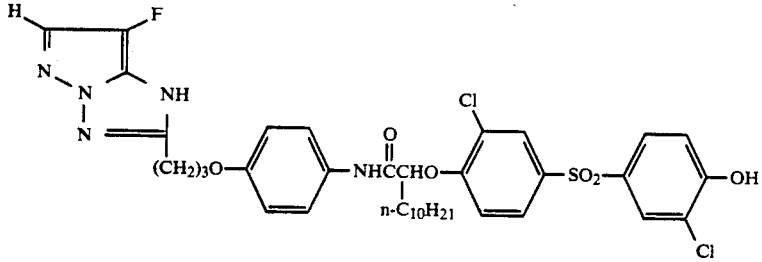
(M-12)
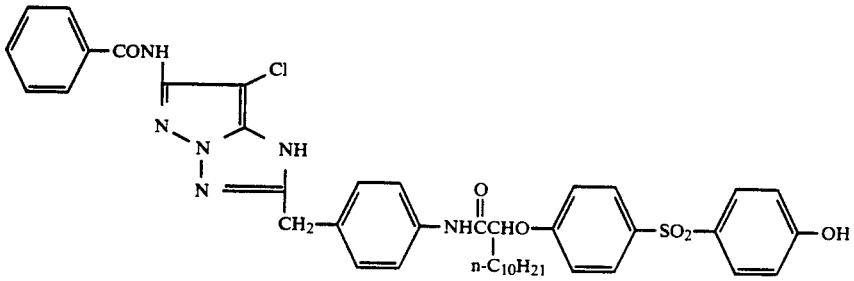

-continued
(M-13)
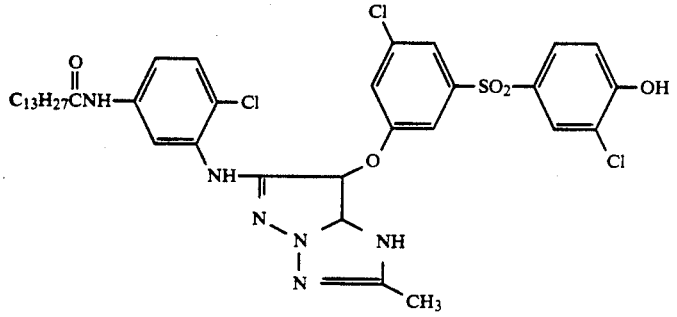
(M-14)
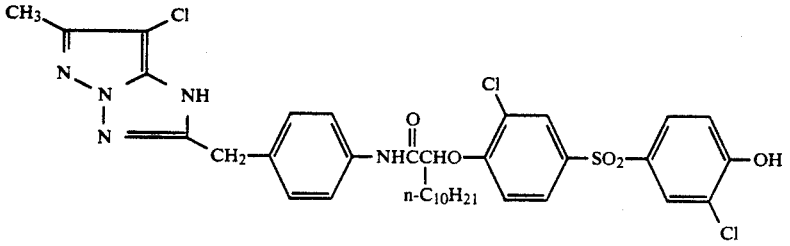
(M-15)
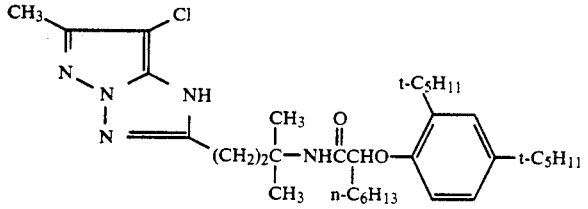
(M-16)
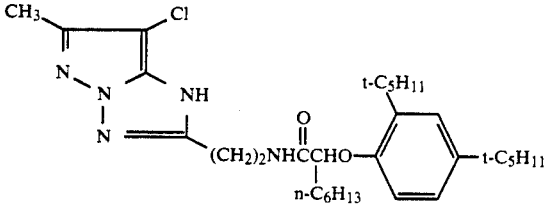
(M-17)
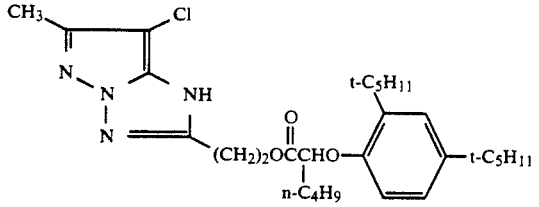
(M-18)
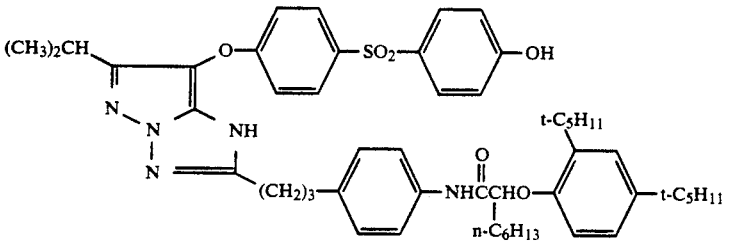
(M-19)
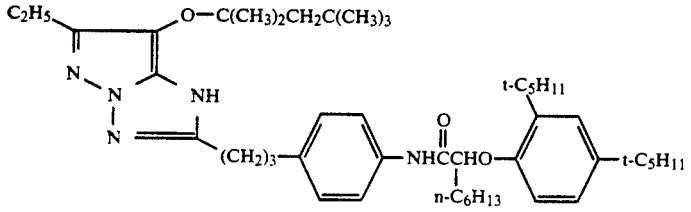

-continued
(M-20)
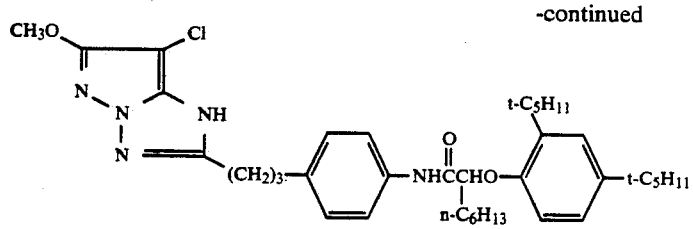
(M-21)
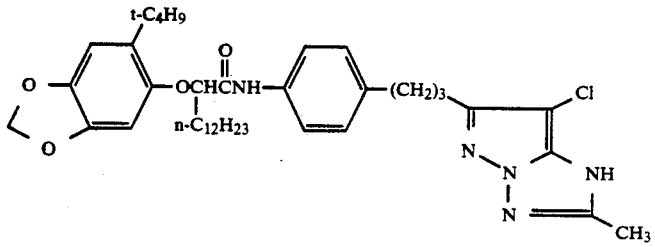
(M-22)
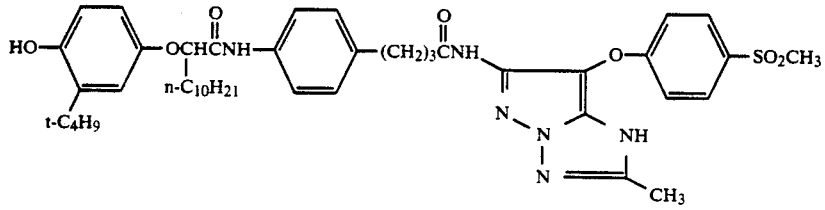
(M-23)
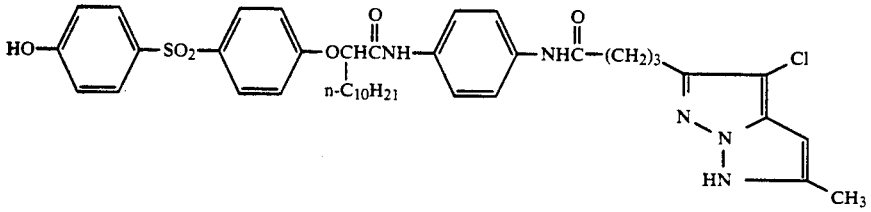
(M-24)
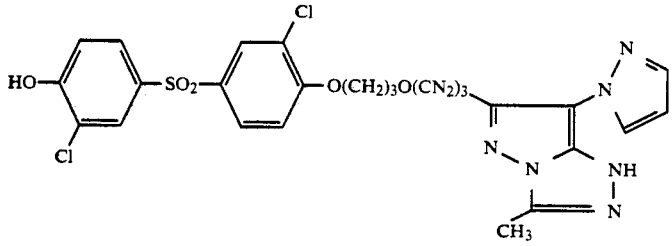
(M-25)
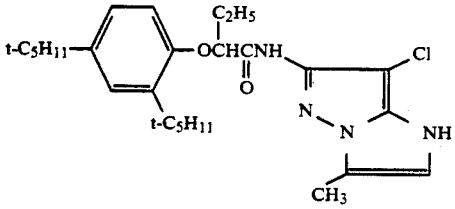
(M-26)
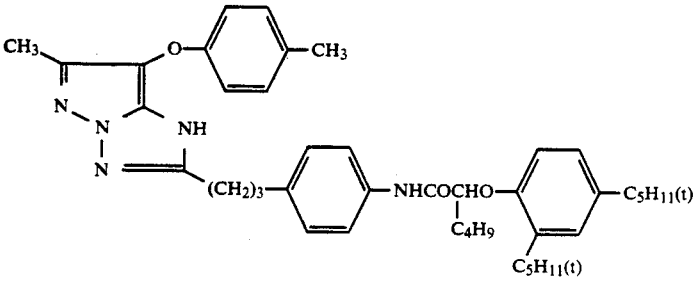

-continued
(M-27)
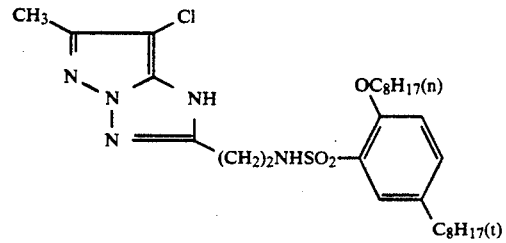
(M-28)
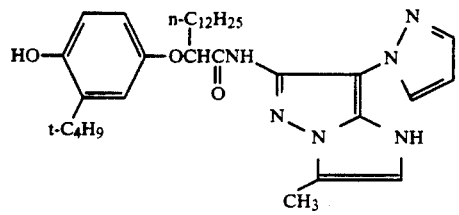
(M-29)
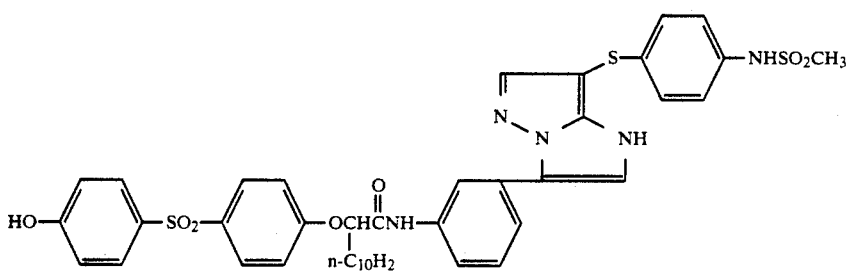
(M-30)
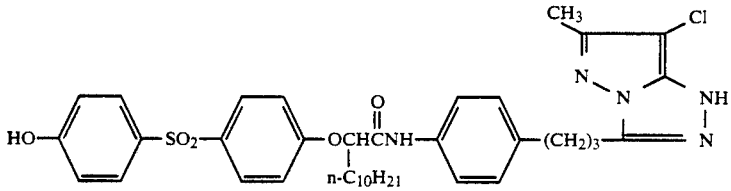
(M-31)
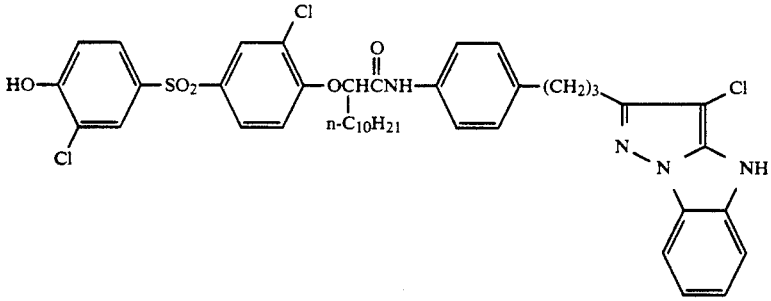
(M-32)
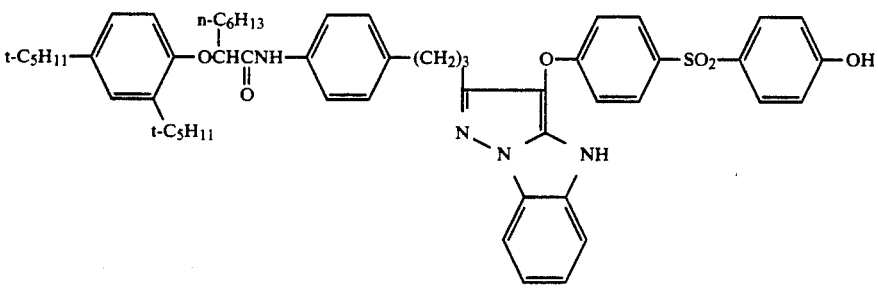

-continued
(M-33)
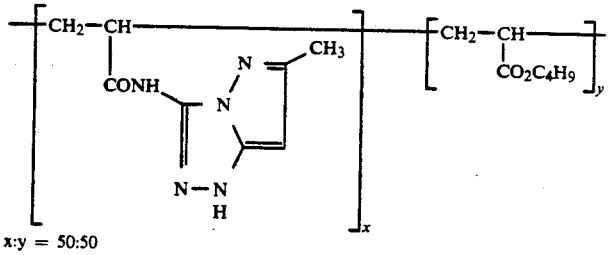
x:y = 50:50
(weight ratio, the same as below)
(M-34)
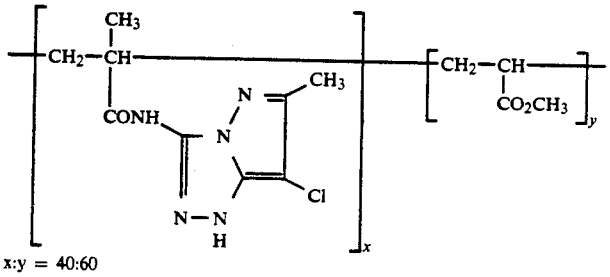
x:y = 40:60
(M-35)
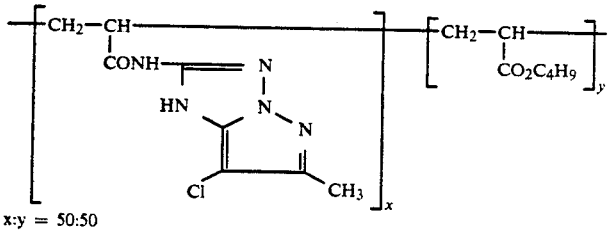
x:y = 50:50
(M-36)
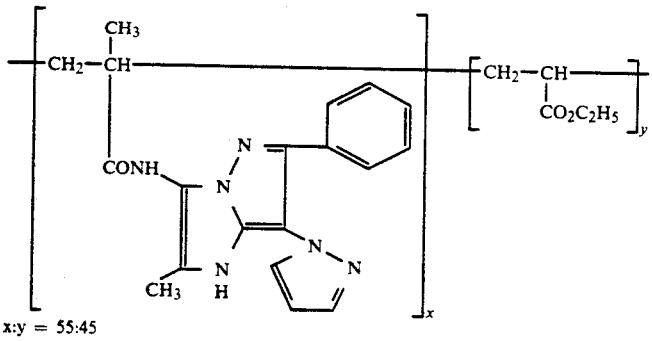
x:y = 55:45
(M-37)
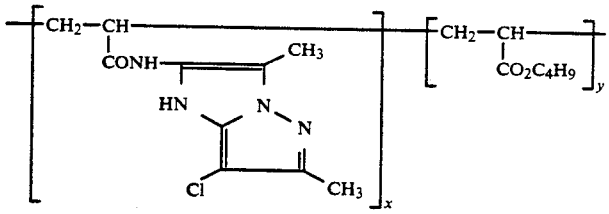
x:y = 50:50
(M-38)
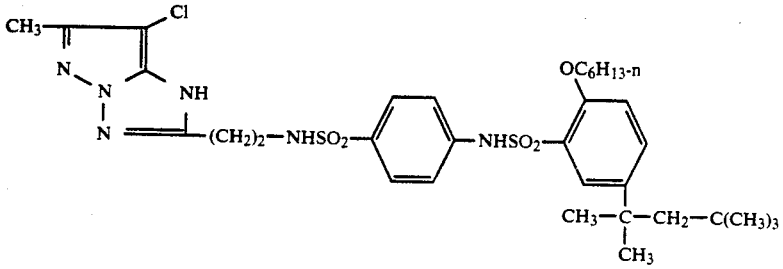

-continued
(M-39)
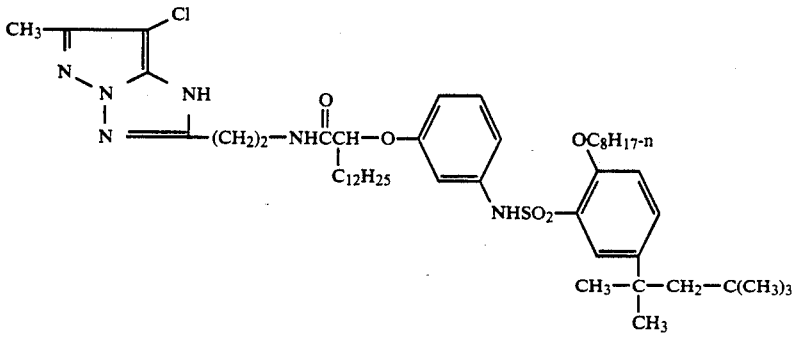
(M-40)
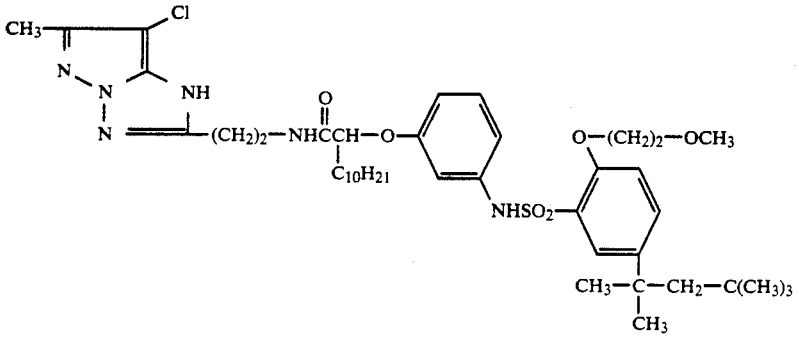
(M-41)
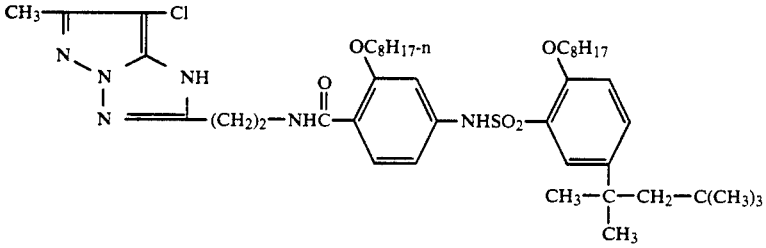
(M-42)
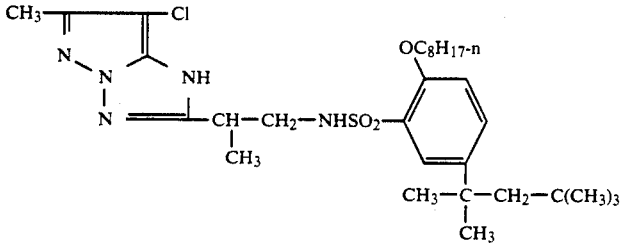
(M-43)
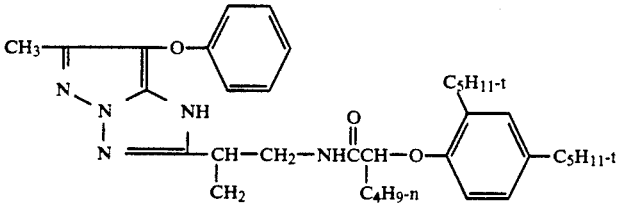
(M-44)
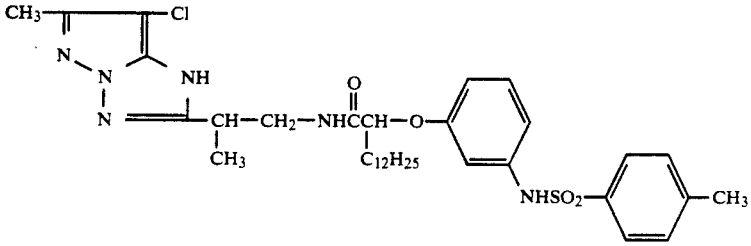

-continued
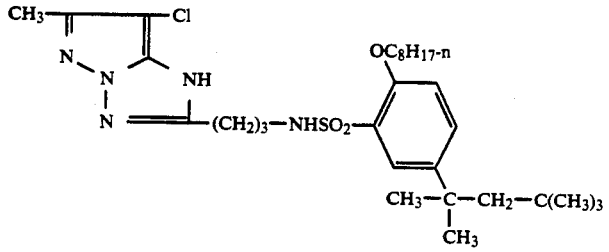
(M-45)
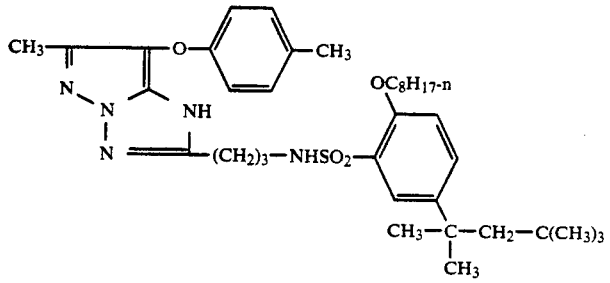
(M-46)
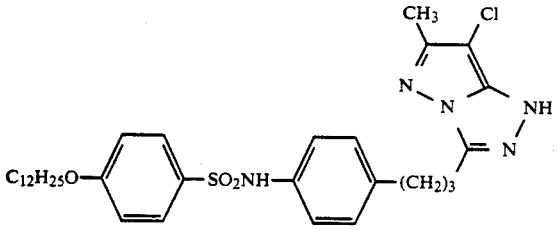
(M-47)
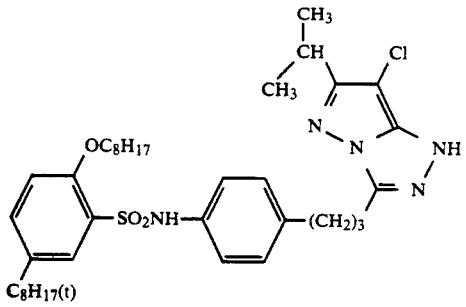
(M-48)
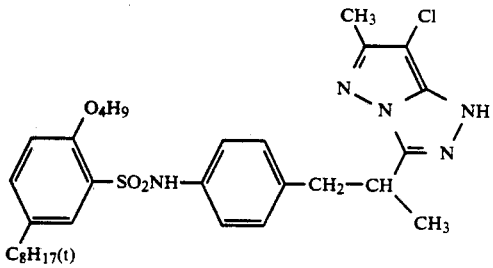
(M-49)

-continued
(M-50)
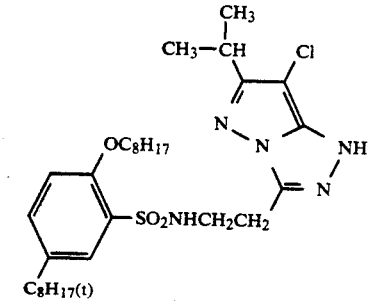
(M-51)
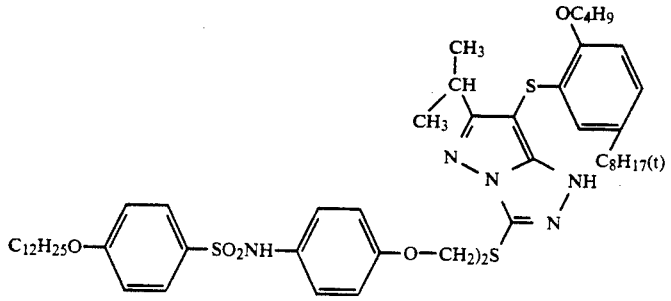
(M-52)
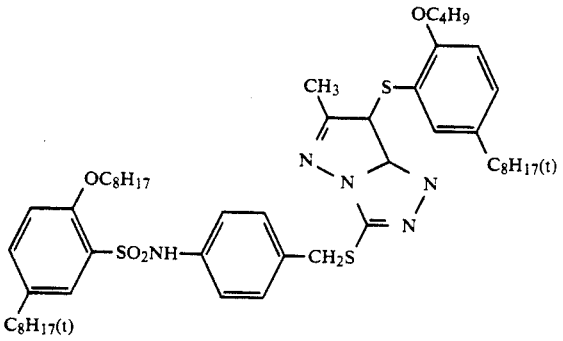
(M-53)
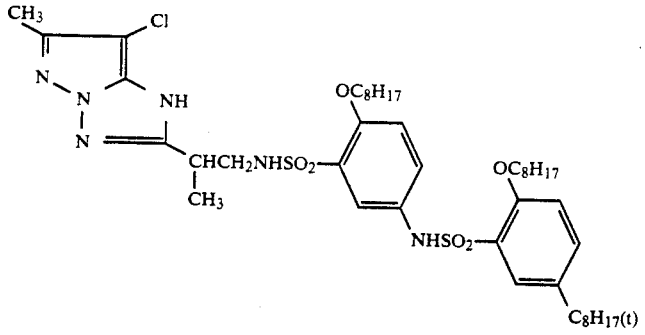
(M-54)
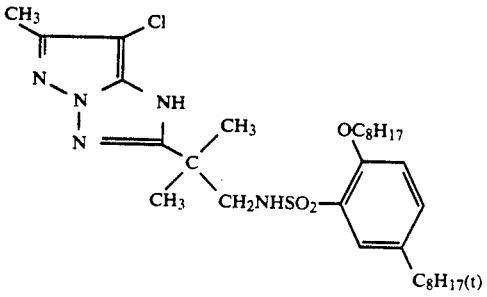

-continued
(M-55)
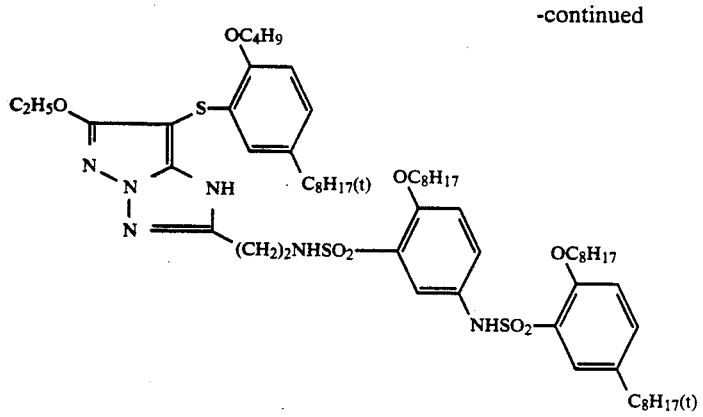
(M-56)
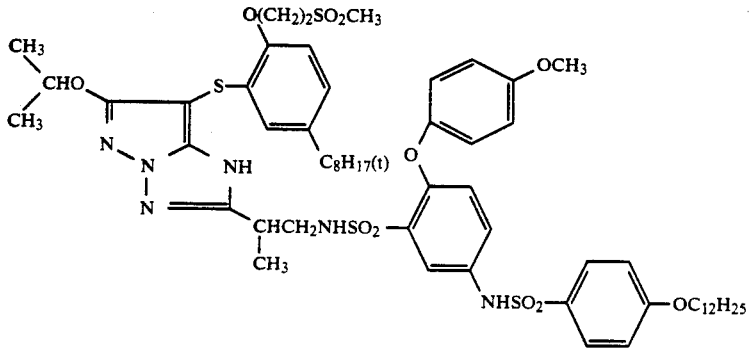
(M-57)
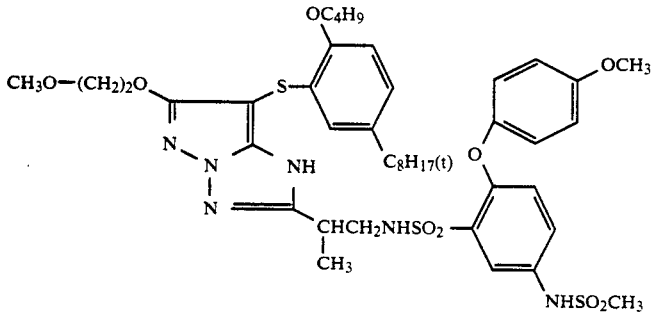
(M-58)
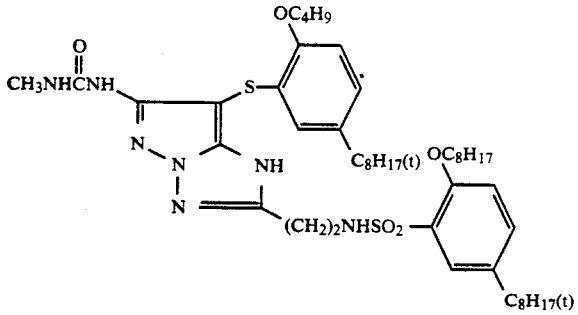
(M-59)
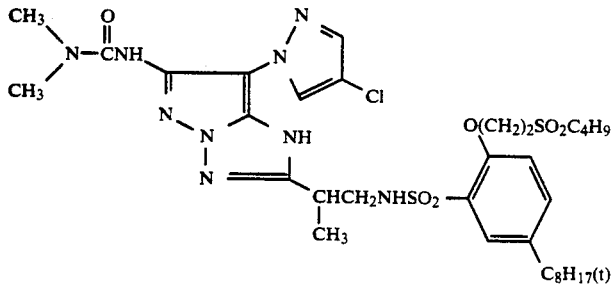

-continued (M-60)

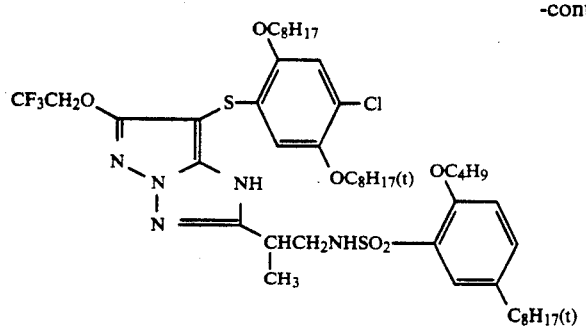

A variety of color couplers may be used in this invention, other than the magenta couplers represented by the general formula (I). Usable color couplers include cyan, magenta and yellow couplers, typical examples being naphtol or phenol base compounds, pyrazolone, and closed- or heterocyclic ketomethylene compounds. Specific examples of the cyan, magenta and yellow couplers, which may be use in this invention, are disclosed in the patents referred to in Research Disclosure (RD) No. 17643 (December, 1978), Section VII-D and RD No. 18717 (November, 1979).

It is preferable that the color couplers included in the photographic material have ballast groups or they are polymerized to be non-diffusible. The required quantity of coating silver can be descresed when a 2-equivalent color coupler, the equivalency thereof being reduced by substitution by releasable groups, rather than using a 4-equivalent color coupler having four active coupling sites. Also usable in this invention are a coupler including a coloring dye having an appropriate dispersibility, a colorless compound forming coupler, a DIR coupler which releases a development inhibitor upon coupling reaction, or a coupler which releases a development accelerator upon coupling reaction.

As the typical examples of yellow couplers used in this invention, it may be mentioned to acylacetoamide base couplers of oil protect type, the specific examples being described in U.S. Pat. Nos. 2,407,210, 2,875,057 and 3,265,506. As described above, a 2-equivalent yellow coupler is used in this invention; and typical examples thereof include yellow couplers of oxygen atom releasing type as described in U.S. Pat. Nos. 3,408,194, 3,447,928, 3,933,501 and 4,022,620 and yellow couplers of nitrogen atom releasing type as described in japanese Patent publication No. 58-10739, U.S. Pat. Nos. 4,401,752 and 4,326,024, RD No. 18053 (April, 1979), British Patent No. 1,425,020 and German OLS Nos. 2,219,917, 2,261,361 and 2,329,587. The α-pivaloylacetoanilide system couplers are excellent in fastness in coloring dyes, particularly fastness or stability against light, whereas the α-benzoylacetoanilide system couplers form colors having high color densities.

As the examples of other magenta couplers which may be used together with the magenta coupler (I) used in a preferred embodiment of this invention, it may be mentioned to oil protect type indazoline base or cyanoacetyl base couplers, the preferred being 5-pyrazolone base couplers.

Among the 5-pyrazolone base couplers, those having substituting arylamino or acylamino groups at the position 3 (3-position) thereof are preferred since they develop coloring dyes having good hue and high densities, the representative examples of such couplers being disclosed, for example, in U.S. Pat. Nos. 2,311,082, 2,343,703, 2,600,788, 2,908,573, 3,062,653, 3,152,896 and 3,936,015. It is preferred that the releasing group of such a 2-equivalent 5-pirazolone base coupler is a nitrogen releasing group as described in U.S. Pat. No. 4,310,619 or a arylthio group as disclosed in U.S. Pat. No. 4,351,897. A further example disclosed by EPC Patent No. 73,636 is a 5-pirazolone base coupler having a ballast group, which form a dye of high optical density.

The cyan couplers which may be used in this invention include oil protect type naphtol base and phenol base couplers, representative examples thereof being a naphtol base coupler described in U.S. Pat. No. 2,474,293 and preferable examples thereof are oxygen atom releasing type 2-equivalent naphtol base couplers described in U.S. Pat. Nos. 4.052,212, 4,146,396, 4,228,233 and 4,296,200. On the other hand, specific examples of the phenol base couplers are disclosed, for example, in U.S. Pat. Nos. 2,369,929, 2,801,171, 2,772,162 and 2,895,826. Cyan couplers which are stable or resistant to humidity and temperature may be preferably used in this invention; the typical examples being a phenol base cyan coupler having an alkyl group higher than ethyl at the meta-position of the phenol ring, as disclosed in U.S. Pat. No. 3,772,002; 2,5-dicyanamino substituted phenol base couplers such as those described in U.S. Pat. Nos. 2,772,162, 3,758,308, 4,126,396, 4,334,011 and 4,327,173, German OLS No. 3,329,729 and Japanese Patent Application No. 58-42671; phenol base couplers each having a phenylureido group at the 2-position thereof and an acylamino group at 5-position thereof, such as those disclosed in U.S. Pat. Nos. 3,446,622, 4,333,999, 4,451,559 and 4,427,767.

Another type usable couplers are those which form colored dyes having proper dispersibility. Such couplers include magenta couplers specifically disclosed in U.S. Pat. No. 4,366,237 and British Patent No. 2,125,570, and yellow, magenta and cyan couplers specifically disclosed in EPC Patent No. 96,570 and German OLS No. 3,234,533.

The dye forming couplers and the aforementioned special type couplers may be used in the form of dimer or higher polymers, excluding the couplers forming the colored dyes having proper dispersibilities. Typical examples of polymerized dye forming couplers are described in U.S. Pat. Nos. 3,451,820 and 4,080,211. Specific examples of polymerized magenta couplers are described in British Patent No. 2,102,173 and U.S. Pat. No. 4,367,282.

Two or more of various couplers may be used in a same photosensitive layer, or any of them may be introduced in different two or more layers to satisfy the required properties of the finished photographic material.

The couplers used in this invention may be introduced by a variety of known dispersion processes, typical processes therefor being a solid dispersion process, an alkali dispersion process, preferably by a latex dispersion process and more preferably by an oil-in-water dispersion process. In the oil-in-water dispersion process, the coupler is initially dissolved in either one or a mixture of an organic high boiling point solvent and/or a so-called assistant solvent having a low boiling point, and then allowed to disperse finely in an aqueous medium, such as water or an aqueous solution of gelatine, in the presence of a surfactant. Examples of the organic high boiling point solvent are described in U.S. Pat. No. 2,322,027 or other publications. Dispersion may be accompanied with a phase conversion, and the assistant solvent may be removed or decreased in content through distillation, noodle washing or ultrafiltration, if necessary.

Specific examples of the organic high boiling point solvent are esters of phtharic acid, such as dibutyl phthalate, dichlorohexyl phthalate, di-2-ethylhexylphthalate and decyl phthalate; esters of phosphoric acid and phosphonic acid, such as triphenyl phospahte, tricresil phosphate, 2-ethylhexyldiphenyl phospahte, trichlorohexyl phosphate, tri-2-ethylhexyl phosphate, tridecyl phosphate, tributoxyethyl phosphate, trichloropropyl phosphate and di-2-ethylhexylphenyl phosphate; esters of benzoic acid, such as 2-ethylhexyl benzoate, dodecyl benzoate and 2-ethylhexyl-p-hydroxy benzoate; amides such as diethyldodecane amide and N-tetradecylpyrrolidone; alcohols and phenols, such as isostearyl alcohol and 2,4-di-tert-aminophenol; esters of aliphatic carboxylic acids, such as dioctyl azelate, glycerol tributylate, isostearyl lactate and trioctyl citrate; derivatives of aniline, such as N,N-dibutyl-2-butoxy-5-tert-octylaniline; and hydrocarbons such as paraffins, dodecylbenzene and diisopropylnaphthalene. On the other hand, usable assistant solvents include organic solvents each having a boiling point of not less than about 30° C., preferably from 50° C. to about 160° C., the typical examples being ethyl acetate, butyl acetate, ethyl propionate, methyl ethyl ketone, cyclohexanone, 2-ethoxyethyl acetate and dimethyl formamide.

The processing steps and effects of the latex dispersion process and specific latex examples used therein are disclosed U.S. Pat. No. 4,199,363 and German OLS Nos. 2,541,274 and 2,541,230.

The standard amount of each of the color couplers ranges generally from 0.001 to 1 mol per one mol of photosensitive silver halide, preferably from 0.01 to 0.5 mols for the yellow couplers, 0.003 to 0.3 mols for the magenta couplers and 0.002 to 0.3 mols for the cyan couplers.

The silver halide emulsion used in this invention includes silver bromide, silver chlomobromide and silver chloride substantially free of silver iodide, and a preferred silver halide composition is silver chlomobromide containing not less than 10 mol % of silver chloride.

Although it is generally preferred that the content of silber bromide is not less than 20 mol % in order to prepare an emulsion having sufficienly high sensitivity without increasing fog, there is a case where the content of silver bromide should be preferably set to less than 20 mol % or 10 mol % to effect rapid processing. A further merit of decrease in content of silver halide, other than the simple improvement in rapid processing, resides in that the developing solution per se is endowed with a rapid processing property due to the fact that the equilibrium accumulation amount of bromine ions, which is determined in relation to the replenishing solution added to the developing solution, could be present at a lower concentration of silver bromide when the photographic material containing silver bromide is subjected to running with a processing solution.

Particles of the silver halide used in this invention may have a multi-layered structure, in which the silver halide particles form different phases respectively in the internal and surface layers, or may a multi-layered structure in which the adjacent layers is bonded through a junction structure, or all of the silver halide particles form a single uniform phase. Furthermore, any of the aforementioned phases may be present in entangled manner.

It is preferred that the silver halide particles used in this invention have average particle sizes of not more than 2 microns and not less than 0.1 microns, particularly preferable range is within the range of not more than 1 micron and not less than 0.15 micron. The size of each particle is defined by the diameter thereof if the particle is spherical or approximately spherical whereas the size of each particle is defined by the length of edge if the particle is cubic, followed by calculation of average projected area. The particle size distribution may be broad or narrow, and it is preferred to use a so-called monodisperse system silver halide emulsion wherein the value (variation factor) obtained by dividing the standard deviation in the particle size distribution curve of the silver halide emulsion by the average particle size is not more than 20%, more preferably within 15%. In order that the photographic material satisfies the target gradation, two or more monodisperse silver halide particles having different particle sizes may be mixed in a same layer in an emulsion layer having substantially the same color sensing property or such two or more monodisperse silver halide particles may be overlaid to form separate laminated layers. It is further possible to use a combination of two or more multidisperse silver halide emulsions or a combination of a monodisperse silver halide emulsion and a multi-disperse emulsion in a mixed form or laminated form.

The shape of the silver halide particles used in this invention may be any of the regular crystalline forms, including cubic, octahedral, dodecahedral or tetradecahedral crystalline forms, or irregular crystalline forms such as spherical form, or may include complex shape formed of any of the aforementioned crystalline forms. It is preferred to use silver halide having the regular crystalline form such as cubic and tetradecahedral forms. Flat plate-shaped particles may also be used in this invention, particularly an emulsion in which 50% or more of the total projected area is occupied by the flat plate-shaped particles having a ratio of length/-thickness of not less than 5, especially not less than 8. The emulsion may be composed of a mixture of particles having various different crystalline shapes. These various emulsions may be surface latent image type emulsion for forming a latent image on the surface thereof, or may be internal latent image type for forming a latent image within the particles, the former being preferred.

The photographic emulsion used in this invention can be prepared by using a method as disclosed in: Glafkides, "Chemie et Physique Photographique", Paul Montel, 1967; G. F. Duffin, "Photographic Emulsion Chemistry", Focal Press, 1966; and V. L. Zelikman et al, "Making and Coating Photographic Emulsion", Focal Press, 1964. That is, the method used may be any of the acidic method, the neutral method, and the ammonia method. Considering the reaction type between the soluble silver salt and the soluble halides, there may be used any of the one-sided mixing method, the simultaneous mixing method, and their combination. The particles may be formed under the condition of excessive silver ions (so-called reverse mixing method). As a simultaneous mixing method, there may be used the method of maintaining the PAg of the solution, in which solution the silver halide generates constant namely the so-called controlled double jet method. Using this method, there can be obtained a silver halide emulsion having regular crystal shape and nearly constant-sized grains.

Also usable in this invention are an emulsion prepared by a so-called conversion method including a step of converting the existing silver halide to silver halide having a smaller solubility product before the completion of the silver halide particle forming step, and an emulsion subjected to similar halogen conversion after the formation of silver halide particles.

During the step of forming silver halide particles or the step of physical ripening, any one or more of salts of cadmium, zinc, lead and tallium, salts or complexes of iridium, salts or complexes of rhodium, salts or complexes of iron may be present.

The silver halide emulsion is subjected to particle forming step, generally followed by physical ripening, demineralization and chemical ripening, and then used in the subsequent coating step.

A known solvent for silver halide (e.g. ammonia, potassium rhodanite, thioether and thione compounds as disclosed in U.S. Pat. No. 3,271,157 and Unexamined Japanese Patent Publication Nos. 51-12360, 53-82408, 53-144319, 54-100717 and 54-155828) may be used in the precipitation and physical and chemical ripening steps. Soluble silver salts may be removed from the emulsion, which has been physically ripened, by noodle washing, flocculation precipitation or ultrafiltration.

The emulsion of silver halide used in this invention may be subjected to a single or combination of the following sensitization process selected from the sulfur sensitization using a sulfur-containing compound (e.g. thiosulfates, thioureas, mercapto compounds and rhodanines), the reducing sensitization using a reducing compound (e.g. salts of tin(II), amines, derivatives of hydrazine, formamizinesulfinic acid, silane compounds) and the precious metal sensitization using a compound of a metal (e.g. complexes of gold, complexes of metals of the Group VIII of the Periodic Table, such as Pt, Ir, Pd, Rh and Fe).

Each of the blue-sensitive, green-sensitive and red-sensitive emulsions used in this invention may be sensitized through spectral sensitization while using a methine dye or other dyes to have the specific color sensitivity. Examples of usable dyes include cyanine dyes, merocyanine dyes, cyanine dyes, merocyanine dyes, holopolar cyanine dyes, hemicyanine dyes, styryl dyes and hemioxonol dyes. Among them, the particularly preferred dyes are cyanine dyes, cyanine dyes and merocyanine dyes. Any of the conventionally applicable basic hetrocyclic rings may be applied to the dyes referred to hereinabove. Examples of applicable rings are: pyrroline ring, oxazoline ring, thiazoline ring, pyrrole ring, oxazole ring, thiazole ring, selenazole ring, imidazole ring, tetrazole ring and pyridine ring; united rings composed of any of the aforementioned rings with aliphatic hydrocarbon rings; and united rings composed of any of the aforementioned rings with aromatic hydrocarbon rings such as indolenine ring, benzindolenine ring, indole ring, benzoxazole ring, naphthooxazole ring, benzothiazole ring, naphthothiazole ring, benzoselenazole ring, benzimidazole and quinoline ring. These rings may be coupled to a carbon atom as substituents.

The merocyanine dyes or the merocyanine dyes may be applied with a five- or six-membered heterocyclic ring, as a ring having a ketomethylene structure, and the examples of such ring include pyrazoline-5-on ring, thiohydantoin ring, 2-thiooxazolidine-2,4-dion ring, thazolidine-2,4-dion ring, rhodanine ring and thiobarbitul ring.

These sensitizing dyes may be used singly or may be used in combination, and a combination thereof is used frequently for the purpose of supersensitization. The representative examples are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patent Nos. 1,344,281 and 1,507,803, Japanese Patent publication Nos. 43-4936 and 53-12375 and Unexamined Japanese Patent Publication No. 52-109925.

The emulsion may contain, together with a sensitizing dye, a material which has no spectral sensitization power or function by itself or does not absorb visible lights but acts as supersensitizer.

The photographic material of this invention may contain an antifoggant or a copor mixing prevention agent selected from derivatives of hydroquinone, derivatives of aminophenol, amines, derivatives of gallic acid, derivatives of catechol, derivatives of ascorbic acid, colorless compound forming coupler and derivatives of sulfonamide.

A known antifading agent may be included in the photographic material of this invention. Typical examples of organic antifading agents are hindered phenols; the representative examples are hydroquinones, 6-hydroxychromans, 5-hydroxycoumarans, spirochromans, p-alkoxyphenols and bisphenols, derivatives of gallic acid, methylenedioxybenzenes, aminophenols, hindered amines and ether or ester derivatives of the afore-listed compounds, such derivatives being prepared by silylation or alkylation of the phenolic hydroxyl group of each of the afore-listed compounds. Further examples of usable antifading agent are metal complexes, and repesentative examples thereof are (bis-salicylaldoximato)nickel complexes and (bis-N,N-dialkyldithiocarbamato)nickel complexes.

A compound having a hindered amine portion and a hindered phenol portion in the single molecule, as that described in U.S. Pat. No. 4,268,593, affords good results for preventing deterioration of a yellow dye image due to heat, humidity and light. In order to prevent deterioration, particularly deterioration by light, it is preferred to use spiroindanes described in Unexamined Japanese Patent Publication No. 159644 or to use chromans substituted by hydroquinone diethers or monoethers as disclosed in Unexamined Japanese Patent Publication No. 55-89835.

It is preferred to add with a benzotriazole base ultraviolet ray absorbing agent for improving the preservability of the cyan image, particularly the fastness or resistance to light. Such an ultraviolet ray absorbing agent may be co-emulsified with the used cyan coupler.

The ultraviolet ray absorbing agent may be coated in an amount sufficient for endowing the cyan dye image with a stability to light. However, the unexposed area (white ground area) of the color photographic material might sometimes be getting yellowish when an excessively large amount thereof is used. In general, the amount of the ultraviolet ray absorbing agent should set to preferably within the range of from $1\times10^{-4}$ mol/m$^2$ to $2\times10^{-3}$ mol/m$^2$, particularly in the range of from $5\times10^{-4}$ mol/m$^2$ to $1.5\times10^{-3}$ mol/m$^2$.

In an ordinary photosensitive layer construction of color paper, an ultraviolet ray absorbing agent is contained in either one adjacent layer, preferably in both adjacent layers, contiguous to the red-sensitive emulsion layer containing a cyan coupler. When an ultraviolet ray absorbing agent is contained in the intermediate layer between the gree-sensitive layer and the red-sensitive layer, the agent may be co-emulsified with the agent for preventing color mixing. When an ultraviolet ray absorbing agent is added to the protection layer, an additional protection layer may be coated or otherwise provided as the outermost layer. The protection layer may contain a mat agent having a desired particle size.

In the photographic material of this invention, an ultraviolet ray absorbing agent may be admixed in the hydrophilic colloid layer.

The photographic material of this invention may have a hydrophilic colloid layer containing a water-soluble dye which serves as a filter dye or provides the functions of preventing irradiation or halation or many other functions.

The photographic material of this invention may include a photographic emulsion layer, or a hydrophilic colloid layer or other layers, containing a brightening agent such as stilbene base, triazine base, oxazole base or coumaline base brighteners. A water-soluble brightener may be used, or a water-insoluble brightener may be used as a dispersed ingredient.

The present invention may be applied to a multi-layered and multi-coloring photographic material including at least two layers having different spectral sensitivities on a support or carrier substrate. The multi-layered photographic material for natural or all colored image development includes generally at least one for each of a red-sensitive emulsion layer, a green-sensitive emulsion layer and a blue-sensitive emulsion layer. The application order or sequential arrangement of these emulsion layers may be determined in compliance with the requirement. Each of the aforementioned emulsion layers may be composed of two or more different emulsion layers, or a non-photosensitive layer may be interposed between the two or more layers having the same color-sensitivity.

It is preferred that an assisting layer is properly provided, other than the silver halide emulsion layers, in the photographic material of this invention, example of such an assisting layer being a protection layer, an intermediate layer, a filter layer, an antihalation layer and a backing layer.

Although it is convenient to use gelatine as the binder or the protective colloid is the emulsion layer(s) or the intermediate layer(s) of the photographic material of this invention, other hydrophilic colloids may be used for the same purpose.

Examples of such hydrophilic colloids include a variety of synthetic, hydrophilic polymer materials; the specific examples being proteins such as derivatives of gelatine, graft polymers of gelatine with other polymers, albumin and casein; derivative of cellulose such as hydroxyethyl cellulose, carboxymethyl cellulose and cellulose sulfonic esters, and derivatives of saccharides such as sodium alginate and starch; homo- or co-polymers, such as polyvinyl alcohol, partially acetylaled polyvinyl alcohol poly-N-vinyl pyrrolidone, polyacrylate, polymethacrylate, polyacrylamides, polyvinylimidazole and polyvinylpyrazole.

As the gelatine used for this purpose includes enzyme-processed gelatine described in "Bull. Soc. Sci. Phot. Japan", No. 16, page 30 (1966), other than the lime-processed gelatine, and decomposition products of gelatine obtained by hydrolysis or enzymatic reaction may also been used.

The photographic material of this invention may be added with a variety of additives, in addition to the aforementioned additives; the examples being various stabilizers, stain-proof agents, developers or precursors thereof, development accelerating agents or precursors thereof, lubricants, mordants, mat agents antistatic agents, plasticizers and other materials conveniently used in the photographic materials. Representative examples of usable additives are disclosed in Research Disclosure Nos. 17643 (December, 1978) and 18716 (November, 1979).

A "reflecting support" which may be used in this invention is provided for increasing the reflection factor so that a clearer image is formed in or on the silver halide emulsion layer or layers; and the reflecting support includes a structure composed of a substrate or carrier coated with a hydrophobic resin containing a dispersed light-reflecting material, such as titanium oxide, zinc oxide, calcium carbonate and calcium sulfate, and a support which is made of a hydrophobic resin containing a dispersed light-reflecting material. Examples of such a support are: baryta paper, paper coated or covered by a polyethylene, paper of polypropylene system synthetic materials and transparent supports which are juxtaposed (or laminated) with or used together with a light-reflecting material layer such as a glass plate, a polyethyleneterephthalate film, polyester films such as films of cellulose triacetate or cellulose nitrate, polyamide films, polycarbonate films and polystyrene films. Thse supports may be selected in consideration of the applied use.

PREFERRED EXAMPLE

The present invention will now be described more in detail, while referring to some preferred Examples thereof. It should be noted here that the following Examples are given by way of example only, and many equivalents, modificatins and alternations thereof may be conceived by those skilled in the art from the teachings of the following Examples and the foregoing descriptions without departing from the spirit and scope of the invention which is broadly defined in the appended claims.

EXAMPLE 1

Samples of multi-layered color print paper having the laminated structure as set forth in Table A were prepared by coating the layers as shown in Table A on a paper sheet support sandwiched between polyethylene films on both sides. The coating solutions were prepared as follows.

Preparation of Solution for the First Layer:

A solution was prepared by dissolveing 19.1 g of a yellow coupler (a) and 4.4 g of a color image stabilizer (b) in 27.2 ml of ethyl acetate and 7.9 ml of a solvent (c), and the solution was dispersed in 185 ml of a 10% gelatine solution containing 8 ml of a 10% solution of sodium dodecylbenzenesulfonate to form an emulsion. On the other hand, 90 g of a blue-sensitive emulsion was prepared by adding a blue sensitive sensitizer dye set forth below to a chlomobromide emulsion (containing 80 mol % of silver bromide and 70 g/kg of Ag) so that the content of the blue sensitive sensitizer dye was $7.0\times10^{-4}$ mol/l mol of chlomobromide. The emulsion of the yellow coupler and the blue-sensitive emulsion were mixed together so that the content of gelatine was adjusted to the value of each composition as shown in Table 1, whereby a coating solution or emulsion for forming a first layer was prepared. The coating solutions or emulsions for forming second to seventh layers were prepared in similar manner. The hardener for gelatine used in each layer was sodium salt of 1-oxy-3,5-dichloro-s-triazine.

The spectral sensitizers used in respective emulsions were those as set forth below:

Blue-sensitive Emulsion Layer:

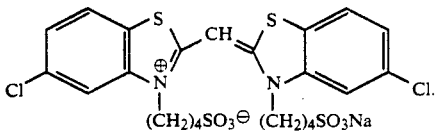

(Added in an amount that $7.0\times10^{-4}$ mol/l of silver halide was contained.)

Green-sensitive Emulsion Layer:

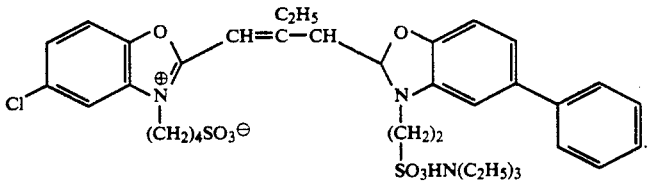

(Added in an amount that $7.0\times10^{-4}$ mol/l mol of silver halide was contained.)

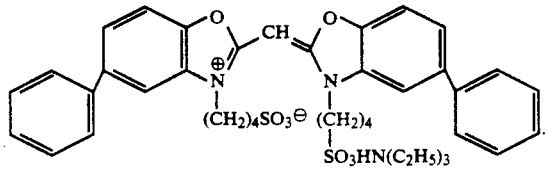

(Added in an amount that $7.0\times10^{-5}$ mol/l mol of silver halide was contained.)

Red-sensitive Emulsion Layer:

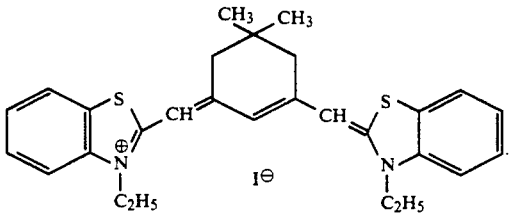

(Added in an amount that $7.0\times10^{-4}$ mol/l mol of silver halide was contained.)

The following dyes were used in respective emulsion layers as irradiation preventing dyes.

Green-sensitive Emulsion Layer:

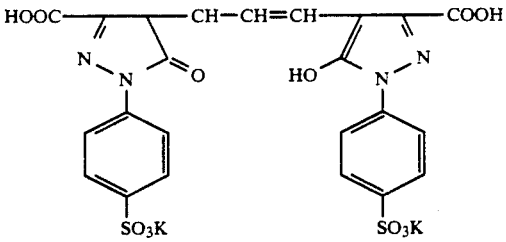

Red-sensitive Emulsion Layer:

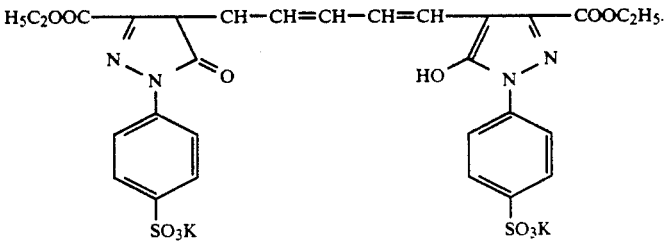

The following compounds represented by the following structural formulae were also used in this Examples as the couplers or other ingredients.
(a) Yellow Coupler:
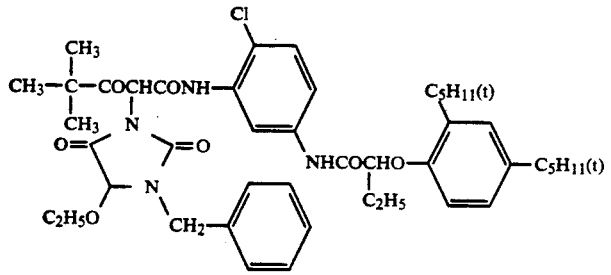
(b) Color Image Stabilizer:
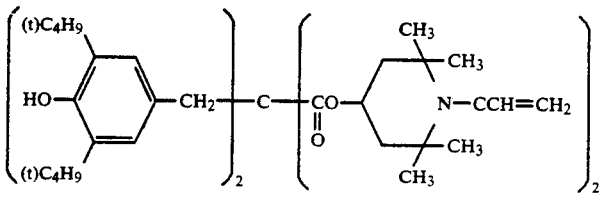
(c) Solvent:
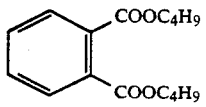
(d)
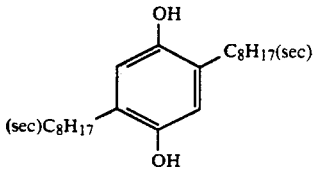
(e) Magenta Coupler (M-55)
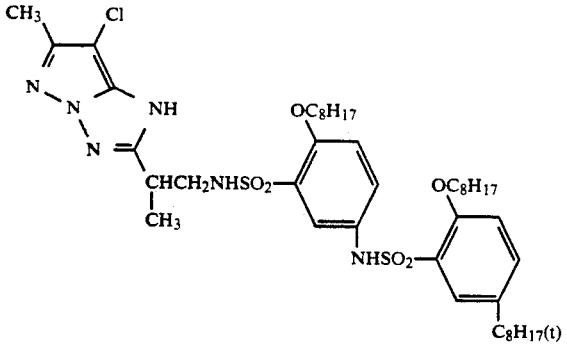
(f) Color Image Stabilizer
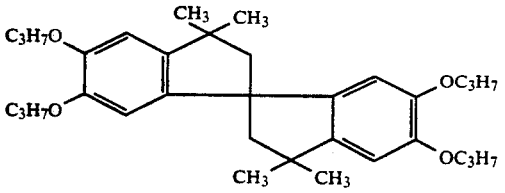
(g) Solvent:
A mixture (2:1 by weight) of the following compounds of:

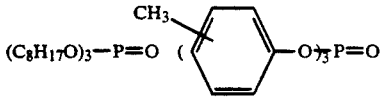

(h) Ultraviolet Ray Absorbing Agent:

A mixture (1:5:3 in molar ratio) of the following compounds of:

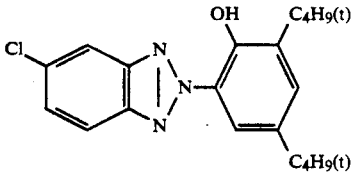

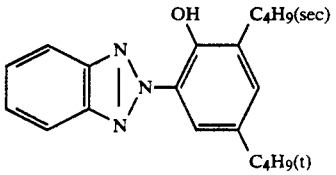

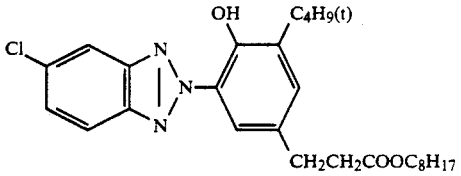

(i) Agent of Prevention of Color Mixing:

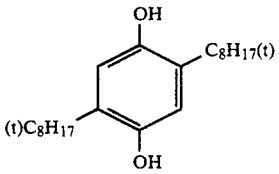

(j) Solvent:

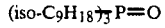

(k) Cyan Coupler:

A mixture (1:1 in molar ratio) of the following compounds of:

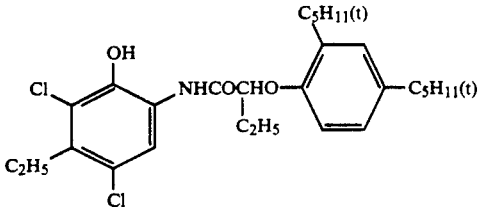

(k1)

and

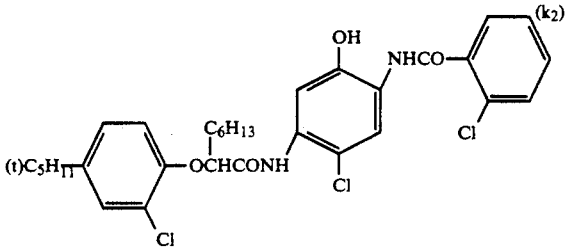

(k2)

(l) Color Image Stabilizer

A mixture (1:3:3 in molar ratio) of the following compounds of:

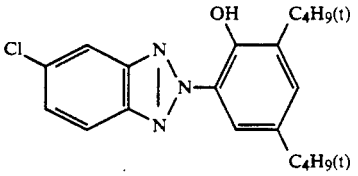

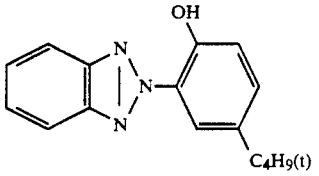

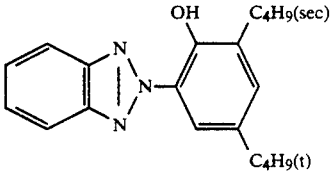

(m) Solvent:

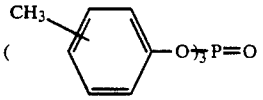

TABLE A

| Layer | Main Ingredient | Used Amount |
|---|---|---|
| Seventh Layer | Gelatine | 1.33 g/m$^2$ |
| (Protection Layer) | | 0.17 g/m$^2$ |
| Sixth Layer | Gelatine | 0.54 g/m$^2$ |
| (UV Ray Absorbing Layer) | Ultraviolet Ray Absorbing Agent (h) | 0.21 g/m$^2$ |
| | Solvent (j) | 0.09 cc/m$^2$ |
| Fifth Layer | Silver Chlomobromid Emulsion | 0.26 g/m$^2$ |
| (Red-sensitive Layer) | (Silver Bromide: 70%) Silver: | |
| | Gelatine | 0.98 g/m$^2$ |
| | Cyan Coupler (k) | 0.38 g/m$^2$ |
| | Color Image Stabilizer (l) | 0.17 g/m$^2$ |
| | Solvent (m) | 0.23 cc/m$^2$ |
| Fourth Layer | Gelatine | 1.60 g/m$^2$ |

TABLE A-continued

| Layer | Main Ingredient | Used Amount |
|---|---|---|
| (UV Ray Absorbing Layer) | Ultraviolet Ray Absorbing Agent (h) | 0.62 g/m$^2$ |
| | Color-mixing Prevention Agent (i) | 0.05 g/m$^2$ |
| | Solvent (j) | 0.26 cc/m$^2$ |
| Third Layer (Green-sensitive Layer) | Silver Chlomobromid Emulsion (Silver Bromide: 75%) Silver: | 0.16 g/m$^2$ |
| | Gelatine | 1.80 g/m$^2$ |
| | Magenta Coupler (e) | 0.34 g/m$^2$ |
| | Color Image Stabilizer (f) | 0.20 g/m$^2$ |
| | Solvent (g) | 0.68 g/m$^2$ |
| Second Layer (Cold-mixing Prevention Layer) | Gelatine | 0.99 g/m$^2$ |
| | Color-mixing Prevention Agent (i) | 0.08 g/m$^2$ |
| First Layer (Blue-sensitive Layer) | Silver Chlomobromide Emulsion (Silver Bromide: 80%) Silver: | 0.30 g/m$^2$ |
| | Gelatine | 1.86 g/m$^2$ |
| | Yellow Coupler (a) | 0.82 g/m$^2$ |
| | Color Image Stabilizer (b) | 0.19 g/m$^2$ |
| | Solvent (c) | 0.34 cc/m$^2$ |
| Support | Polyethylene Laminate Paper (The polyethylene film at the side facing to the First Layer contains a white pigment ($TiO_2$) and a blue dye (ultramarine).) | |

Each of the thus prepared multi-layered color print paper sheets was subjected to continuous processing including the processing steps A to C until the contents in respective color developing tanks had been replenished by the relenishers in the amounts of 3 times of the originally contained solutions or emulsions. The processing times tabulated in the following Table indicate the times in respective baths.

| Processing Step | A (Comparative Example) (min-second) | B (Comparative Example) (min-second) | C (Present Invention) (min-second) |
|---|---|---|---|
| Color Development (35° C.) | 2-0 | 2-00 | 2-00 |
| Bleaching-and-Fixing (33° C.) | 1-30 | 1-00 | 1-00 |
| Rinse 1 (30° C.) | 1-00 | 0-20 | 0-20 |
| Rinse 2 (30° C.) | 1-00 | 0-20 | 0-20 |
| Rinse 3 (30° C.) | 1-00 | 0-20 | 0-20 |
| Drying (80° C.) | 0-50 | 0-50 | 0-20 |

Rinsing was effected by washing with water in a three stage counter-current rinsing system having three rinse baths of Rinse 3 to Rinse 1 arranged in this order.

The color developing solutions used in the processing steps A and B are as follows.

| Color Developer | Liquid in Tank | Replenisher |
|---|---|---|
| Water | 800 ml | 800 ml |
| Diethyltriamine Pentaacetate | 3.0 g | 3.0 g |
| Benzyl Alcohol | 15 ml | 19 ml |
| Diethylene Glycol | 10 ml | 10 ml |
| Sodium Sulfite | 2.0 g | 2.3 g |
| Potassium Bromide | 0.5 g | — |
| Potassium Carbonate | 30.0 g | — |
| N-ethyl-N-(β-methanesulfoneamido-ethyl)-3-methyl-4-amino-aniline sulfate | 5.5 g | 7.5 g |
| Hydroxylamine Sulfonate | 4.0 g | 4.5 g |
| Fluorescent Brightening Agent | 1.0 g | 1.5 g |
| (Adding Balance Water) | 1000 ml | 1000 ml |
| (pH adjusted with KOH) | pH 10.20 | pH 10.60 |

A composition of the solution used in the processing step C was prepared similar to the processing solutions for the processing steps A and B tabulated hereinabove, except that benzyl alcohol was excluded.

The compositions of the bleaching-and-fixing solutions used in the processing steps A, B and C are as follows:

| Bleaching-and-Fixing Solution | Liquid in Tank | Replenisher |
|---|---|---|
| Water | 800 ml | 800 ml |
| Ammonium Thiosulfate | 150 ml | 300 ml |
| Sodium Sulfite | 18 g | 36 g |
| Ammonium Iron (III) Ethylenediamine Tetraacetate | 55 g | 110 g |
| Ethylenediamine Tetraacetate | 5 g | 10 g |
| (Adding Balance Water) | 1000 ml | 1000 ml |
| (pH adjusted with KOH) | pH 6.75 | pH 6.30 |

The composition of the rinsing solution used in the processing steps A, B and C is as follows:

| Rinsing Solution | Liquid in Tank | Replenisher |
|---|---|---|
| 1-Hyroxyethylidene-1,1-diphosphonic Acid (60%) | 2.5 ml | 2.5 ml |
| Aqueous Ammonia (28%) | 1.8 ml | 1.8 ml |
| (Adding Balance Water) | 1000 ml | 1000 ml |
| (pH adjusted with KOH) | pH 7.0 | pH 7.0 |

The amounts of the replenishers added respectively to the color developer, the bleaching-and-fixing solution and the rinsing solutions wer 160 ml, 60 ml and 200 ml per 1 m$^2$ of the photographic print paper.

In each of the processing steps A, B and C, the change in cyan concentration during the continuous processing was measured, while processing the photographic print paper exposured to have the cyan concentration at the start-up of 2.0. The cyan concentration at the termination of the continuous processing are shown in the following Table 1.

On the other hand, unexposed print paper was processed or dipped after the termination of the continuous processing, and allowed to stand for 6 days at 100° C., and the densities of yellow stain and magenta stain were measured.

Further experiments were conducted to know the days until floating substances were found on the surfaces of respective rinsing solutions (Rinse 1 to Rinse 3), while keeping the automatic developing machine in stand-still condition after the termiantion of the aforementioned continuous processing.

The results are shown collectively in Table 1.

TABLE 1

| Process | Cyan Concentration | | Stain after* processing | | Day until Floating Contaminants Found | | |
|---|---|---|---|---|---|---|---|
| | Initial Stage | End Point | Yellow | Magenta | Rinse 1 | Rinse 2 | Rinse 3 |
| A (Comparative Example) | 2.00 | 1.80 | 0.15 | 0.20 | 7 | 2 | 3 |
| B (Comparative Example) | 2.00 | 1.60 | 0.20 | 0.35 | 5 | 1 | 2 |
| C (Present Invention) | 2.00 | 1.97 | 0.08 | 0.06 | 30 | 14 | 16 |

*Note: Increase in Stain after the lapse of 6 days, when the processed prints were held at 100° C.

After the determiantion of cyan concentration, the samples obtained by the processing steps A and B were dipped in a bleaching solution (CN-16, N2-R, Produced by Fuji Film, Co. Ltd.) for 2 minutes, washed with water, and the cyan concentration were measured again to found that the cyan concentration were changed to 2.02 and 2.01, respesctively. This shows that the failure in cyan color restoration was resulted.

In the processing step B wherein the times for bleaching-and-fixing and for washing were shortened as compared to the processing step A, the stain problems and the intention of formation of the floating substance become more serious; whereas the results of all tested items are remarkedly improved by the processing step C (present invention) wherein only benzyl alcohol is excluded or removed from the processing step B. The effect of removal of benzyl alcohol should be appreciable, accordingly.

| | Liquid in Tank | Replenisher |
|---|---|---|
| Rinse (a) | | |
| Ethylenediamine Tetraacetate, ZNa | 2.0 g | 2.0 g |
| (Adding with Balance Water) | 1000 ml | 1000 ml |
| pH Value | 7.0 | 7.0 |
| Rinse (b) | | |
| 1,2,3-Banzotriazole | 1.0 g | 1.0 g |
| Ethylenediamine-N,N,N',N' tetramethylenephosphonic Acid | | |
| $(NH_4)_2SO_3$ | 2.0 g | 2.0 g |
| (Adding with Balance Water) | 1000 ml | 1000 ml |
| pH Value | 7.0 | 7.0 |
| Rinse (c) | | |
| Sulfanylamide | 1.0 g | 1.0 g |
| (Adding with Balance Water) | 1000 ml | 1000 ml |
| pH Value | 7.0 | 7.0 |
| Rinse (d) | | |
| 5-Chloro-2-methyl-4-isothiazoline-3-one | 30 ml | 30 ml |
| (Adding with Balance Water) | 1000 ml | 1000 ml |
| pH Value | 7.0 | 7.0 |

TABLE 2

| Rinsing Solution | Process | | Stains* Found after Processing | | Day until Floating Contaminants Found |
|---|---|---|---|---|---|
| | | | Yellow | Magenta | |
| (a) | B | Comparative Example | 0.15 | 0.33 | 1 |
| | C | Present Invention | 0.10 | 0.07 | 18 |
| (b) | B | Comparative Example | 0.16 | 0.35 | 3 |
| | C | Present Invention | 0.09 | 0.06 | 19 |
| (c) | B | Comparative Example | 0.17 | 0.40 | 1 |
| | C | Present Invention | 0.11 | 0.06 | 13 |
| (d) | B | Comparative Example | 0.18 | 0.41 | 5 |
| | C | Present Invention | 0.11 | 0.06 | 20 |

Note: Under the same condition as described in the foot-note of Table 1.

EXAMPLE 2

The same samples were processed generally following to the procedures as set forth in Example 1, except that the rinsing solutions used in Example 1 were substituted by the following rinsing solutions (a) to (d). The results relating to the change in stain by processing and the days until the occurrence of floating substance (flocculation) are shown in Table 2.

As will be apparent from Table 2, according to this invention, formations of stains and the floating substances after the processing had been suppressed remarkedly.

EXAMPLE 3

Multi-layered color print paper sheets (a) to (g) were prepared generally similar to the multi-layered color print sheets as prepared in Example 1, except that the emulsions used in respective layers were changed as shown in the following Table B, and yellow and cyan couplers as set forth below were used in place of those used in Example 1, the magenata couplers used being set forth in Table 3.

TABLE B

| Layer | Composition of Chlomobromille Emulsion | Shape of Emulsion Particles | Average Particle Sizes | Amount of Added Sensitizer Dye (per 1 mol of Ag) |
|---|---|---|---|---|
| Blue-sensitive | Silver Bromide: 4 mol % | Cubic | 0.95 | $5 \times 10^{-4}$ mol |

TABLE B-continued

| Layer | Composition of Chlomobromille Emulsion | Shape of Emulsion Particles | Average Particle Sizes | Amount of Added Sensitizer Dye (per 1 mol of Ag) |
|---|---|---|---|---|
| Emulsion | | | | |
| Green-sensitive Emulsion | Silver Bromide: 10 mol % | Cubic | 0.45 | Same as Example 1 |
| Red-sensitive Emulsion | Silver Bromide: 10 mol % | Cubic | 0.45 | Same as Example 1 |

The following magenta couplers were used.

m-1

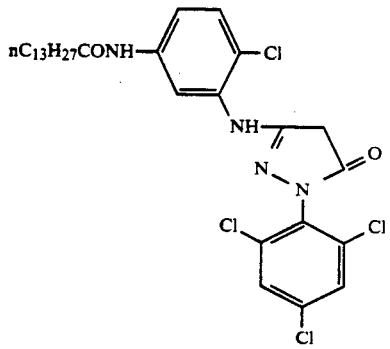

m-2

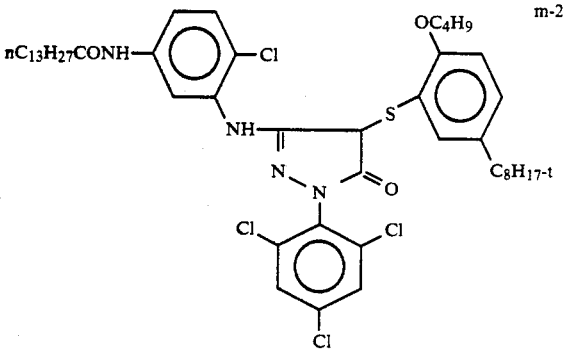

-continued m-3

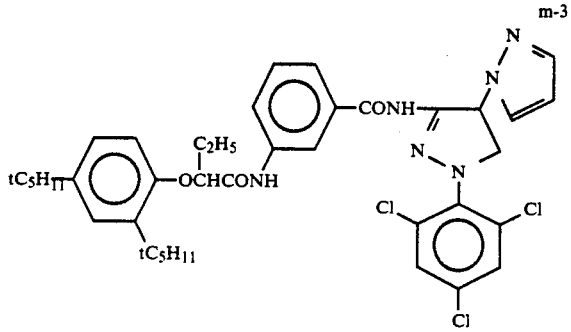

The following yellow coupler was used.

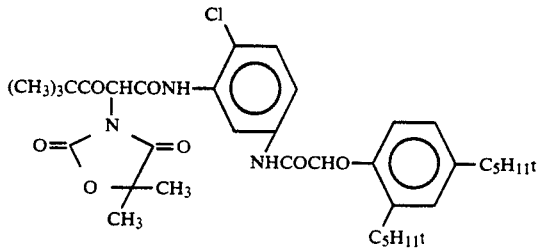

A mixture (1:1 by molar ratio) of the following two couplers was used as the cyan coupler.

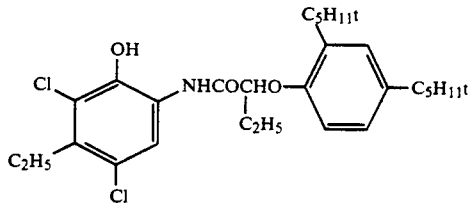

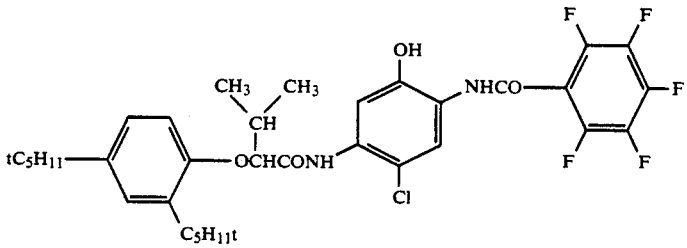

The thus formed color print sheets were exposed to light through a mask having a wedge-like opening, and then subjected to the following processing steps.

| Processing Step | Time* | Temp. |
|---|---|---|
| Color Development | 45 sec. | 35° C. |
| Bleaching-and-Fixing | 45 sec. | 35° C. |

-continued

| Processing Step | Time* | Temp. |
|---|---|---|
| Rinse (1) | 20 sec. | 35° C. |
| Rinse (2) | 20 sec. | 35° C. |
| Rinse (3) | 20 sec. | 35° C. |
| Drying | 60 sec. | 80° C. |

* Note: Time for transportation in air is subtracted.

The compositions of the processing solutions used in respective steps are as follows.

| | |
|---|---|
| Color Developer: | |
| Water | 800 ml |
| 1-Hydroxyethylidene-1,1-disulfonic Acid (60% Solution) | 1.5 ml |
| Lithium Chloride | 1.0 g |
| Diethylenetriamine Pentaacetate | 1 g |
| 4,5-Dihydroxy-m-benzenedisulfonic Acid | 1.0 g |
| Benzyl Alcohol | Table 3 |
| Diethylene Glycol | Table 3 |
| Sodium Sulfite | 0.5 g |
| Potassium Bromide | 0.1 g |
| Sodium Chloride | 1.5 g |
| Adenine | 30 mg |
| Potassium Carbonate | 40 g |
| N-Ethyl-N-(β-methanesulfoneamide ethyl)-3-methyl-4-aminoaniline sulfate | 4.5 g |
| Hydroxylamine Sulfate | 3.0 g |
| Fluorescent Brightening Agent (Whitex 4, produced by Sumitomo Chemical, Co., Ltd.) | 1.0 g |
| Poly(ethyleneimine) (50% Aqueous Solution) | 3.0 g |
| (Adding with balance water) | 1000 ml |
| (pH Value Adjusted by KOH) | pH 10.25 |
| Bleaching-and-Fixing Solution: | |
| Water | 400 ml |
| Ammonium Thiosulfate (70%) | 150 ml |
| Sodium Sulfite | 15 g |
| Ammonium Iron (III) Ethylenediamine Tetraacetate | 55 g |
| Ethylenediamine Tetraacetic acid | 5 g |
| Color Developer set forth above | 200 ml |
| pH Value | pH 7.0 |
| Rinsing Solution: | |
| 1-Hydroxyethylidene-1,1-disulfonic Acid (60%) | 1.5 ml |
| Nitrilo Triacetic Acid | 1.0 g |
| Ethylenediamine Tetraacetic Acid | 0.5 g |
| N,N,N',N'-Tetramethylene Sulfonic Acid | 1.0 g |
| $BiCl_3$ (40% Aqueous Solution) | 0.50 g |
| $MgSO_4.7H_2O$ | 0.20 g |
| $ZnSO_4$ | 0.3 g |
| Aluminium Alum | 0.5 g |
| 5-Chloro-2-methyl-4-isothiazoline-3-one | 30 ml |
| 2-Octyl-4-isothiazoline-3-one | 10 mg |
| Ethylene Glycol | 1.5 g |
| Sulfanylamide | 0.1 g |
| 1,2,3-Benzotriazole | 1.0 g |
| Ammonium Sulfite (40% Aqueous Solution) | 1.0 g |
| Aqueous Ammonia Solution (26%) | 2.6 ml |
| Polyvinylpyrrolidone | 1.0 g |
| Fluorescent Brightening Agent (4,4'-Diaminodstilbene Base) | 1.0 g |
| (Adding with Balance Water) | 1000 ml |
| (pH adjusted with KOH) | 7.0 |

The rinse (1) was the one which was prepared by adding 10% of the bleaching-and-fixing solution to the rinsing solution set forth above. The rinse (2) and rinse (3) were prepared by adding, respectively with 1% for the rinse (2) and 0.1% for the rinse (3), of the bleaching-and-fixing solution. The rinsing solutions under running condition were simulated.

The $D_{min}$ of the each of the processed print sheets was measured by Macbeth densitometer, and the increase in magenta stains in each specimen after the lapse of 30 days was measured. The result are shown in Table 3.

TABLE 3

| Magenta Coupler | Benzyl Alcohol/ Diethylene Alcohol (ratio in mol) | | $D_G$ min |
|---|---|---|---|
| (a) | 15 ml/10 ml | Comparative Example | +0.35 |
| m-1 | — | Present Invention | +0.14 |
| (b) | 15 ml/10 ml | Comparative Example | +0.38 |
| m-2 | — | Present Invention | +0.16 |
| (c) | 15 ml/10 ml | Comparative Example | +0.36 |
| m-3 | — | Present Invention | +0.14 |
| (d) | 15 ml/10 ml | Comparative Example | +0.41 |
| M-30 | — | Present Invention | +0.08 |
| (e) | 15 ml/10 ml | Comparative Example | +0.44 |
| M-53 | — | Present Invention | +0.06 |
| (f) | 15 ml/10 ml | Comparative Example | +0.40 |
| M-55 | — | Present Invention | +0.06 |
| (g) | 15 ml/10 ml | Comparative Example | +0.36 |
| M-57 | — | Present Invention | +0.04 |

When the photographic material was processed in a color developing solution which was substantially free of bendyl alcohol, according the most importance feature of this invention, increase in stains after processing was prevented; and when any of the magenata couplers (M-30, M-53, M-55, M-57) as recommended by a further feature of this invention was used, noticiable enhancement in advantageous effects had been achieved.

EXAMPLE 4

As shown in Table C, a laminated paper sheet applied or laminated with polyethylene sheet on both sides thereof and pre-processed through a corona discharge was coated with the layers, i.e. the first layer (lowermost layer) to the seventh layer (uppermost layer), whereby specimen No. 44 was prepared.

The coating solution for the first layer was prepared following to the procedures as described below. Namely, 600 ml of ethyl acetate was added, as an assistant solvent, to a mixture of 200 g of a yellow coupler shown in Table C, 93.3 g of antifading agent, 10 g (p) and 5 g (q) for each of the high boiling point solvents (p) and (q). After heating the admixture to 60° C. to dissolve the ingredients, 3,300 ml of an aqueous solution of gelatine containing 330 ml of a 5% aquesous solution of Alkanol B (an alkylnaphthalenesulfonate, produced by E. I. du Pont de Nemours & Co.) was mixed therewith, followed by emulsification in a colloid mill, to prepare a coupler dispersion. Ethyl acetate was distilled from the dispersion under reduced pressure, and the dispersion deprived of ethyl acetate was added to 1400 g of an emulsion (containing 96.7 g of Ag and 170 g of gelatine) which had been added with a sensitizing dye for the blue-sensitive emulsion layer and 1-methyl-2-mercapto-5-acetylamino-1,3-4-triazole, and then added with 2,600 g of a 10% aqueous solution of gelatine to prepare a coating solution.

The coating solutions for the second to seventh layers were prepared generally similar to the procedures for preparing the coating solution for the first layer.

TABLE C

| Layer | Composition | |
|---|---|---|
| Seventh Layer | Gelatine | 600 mg/m² |

TABLE C-continued

| Layer | Composition | |
|---|---|---|
| (Protection Layer) | | |
| Sixth Layer | Ultraviolet Ray Absorbing Agent (n) | 260 mg/m$^2$ |
| (UV Ray Absorbing Layer) | Ultraviolet Ray Absorbing Agent (o) | 70 mg/m$^2$ |
| | Solvent (p) | 300 mg/m$^2$ |
| | Solvent (q) | 100 mg/m$^2$ |
| | Gelatine | 700 mg/m$^2$ |
| Fifth Layer | Silver Chlomobromide Emulsion | 210 mg/m$^2$ |
| (Red-sensitive Layer) | (Silver Bromide: 1 mol %) | |
| | Cyan Coupler (C-2) | 260 mg/m$^2$ |
| | Cyan Coupler (C-1) | 120 mg/m$^2$ |
| | Anti-fading Agent (r) | 250 mg/m$^2$ |
| | Solvent (p) | 160 mg/m$^2$ |
| | Solvent (q) | 100 mg/m$^2$ |
| | Gelatine | 1800 mg/m$^2$ |
| Fourth Layer | Agent for Prevention of Color-mixing (s) | 65 mg/m$^2$ |
| (Color-mixing Prevention | Ultraviolet Ray Absorbing Agent (n) | 450 mg/m$^2$ |
| Layer) | Ultraviolet Ray Absorbing Agent (o) | 230 mg/m$^2$ |
| | Solvent (p) | 50 mg/m$^2$ |
| | Solvent (q) | 50 mg/m$^2$ |
| | Gelatine | 1700 mg/m$^2$ |
| Third Layer | Silver Chlomobromide Emulsion | 305 mg/m$^2$ |
| (Green-sensitive Layer) | (Silver Bromide: 3 mol %) | |
| | Magenta Coupler | 670 mg/m$^2$ |
| | Antifading Agent (t) | 150 mg/m$^2$ |
| | Antifading Agent (u) | 10 mg/m$^2$ |
| | Solvent (p) | 200 mg/m$^2$ |
| | Solvent (q) | 10 mg/m$^2$ |
| | Gelatine | 1400 mg/m$^2$ |
| Second Layer | Silver Chlomobromide Emulsion | 10 mg/m$^2$ |
| (Cold-mixing Prevention | (not after-ripened Particles Size: | |
| Layer) | 0.05 micron) Silver | |
| | Agent for Prevention of Color-mixing (s) | 55 mg/m$^2$ |
| | Solvent (p) | 30 mg/m$^2$ |
| | Solvent (q) | 15 mg/m$^2$ |
| | Gelatine | 800 mg/m$^2$ |
| First Layer | Silver Cholombromide Emulsion | 290 mg/m$^2$ |
| (Blue-sensitive | (Silver Bromide: 5 mol %) | |
| Layer) | Yellow Coupler | 600 mg/m$^2$ |
| | Antifading Agent (r) | 280 mg/m$^2$ |
| | Solvent (p) | 30 mg/m$^2$ |
| | Solvent (q) | 15 mg/m$^2$ |
| | Gelatine | 1800 mg/m$^2$ |
| Support | Paper Support Laminated with polyethylene at both sides. | |

n: 2-(2-Hydroxy-3,5-di-tert-amylphenyl)benzotriazole
o: 2-(2-Hydroxy-3,5-di-tert-butylphenyl)benzotriazole
p: Di(2-ethylhexyl) Phthalate
q: Dibutyl Phthalate
r: 2,5-Di-tert-amylphenyl-3,5-di-tert-butylhydroxybezoate
s: 2,5-Di-tert-octylhydroquinoene
t: 1,4-Di-tert-amyl-2,5-dioctyloxybenzene
u: 2,2'-Methylenebis(4-methyl-6-di-tert-butylphenol)

The following compounds were used as the sensitizing dyes for respective emulsion layers.

Blue-sensitive Emulsion Layer:

Anhydro-5-methoxy-5'-methyl-3,3'-disulfopropylselenacyaninehydroxide

Green-sensitive Emulsion Layer:

Anhydro-9-ethyl-5,5'-3-3'-disulfoethyloxacarbocyaninehydroxy

Red-sensitive Emulsion Layer:

3,3'-diethyl-5-methoxy-9,9'-(2,2-dimethyl-1,3-propano)-thiadicarboxycyanine iodyde The following compound was used as a stabilizer for the emulsion layers:

1-Methyl-2-mercapto-5-acetylamino-1,3,4-triazole

The following compounds were used as irradiation preventing dyes:

Dipotassium 4-(3-carboxy-5-hydroxy-4-(3-(3-carboxy-5-oxy-1-(4-sulfonatophenyl)-2-pyrazoline-4-ylidene-1-propenyl)-1-pyrazoryl)benzenesulfonate Tetrasodium N,N'-(4,8-dihydroxy-9,10-dioxo-3,7-disulfonatoanthracene-1,5-diyl)bis(aminomethanesulfonate 1,2-bis(vinylsulfonyl)ethane was used as a hardener. The following couplers were used.

Yellow Coupler:

-continued

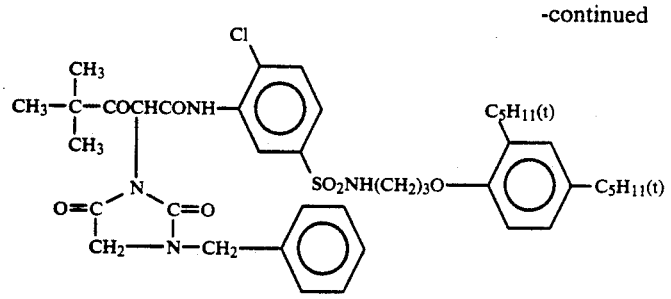

Magenta Coupler:

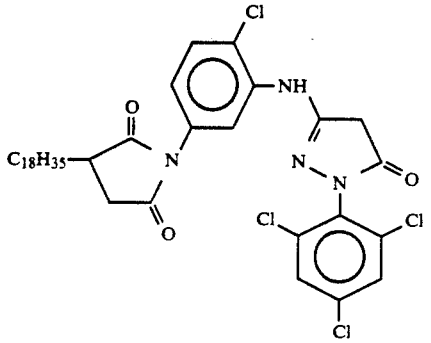

Cyan Coupler:

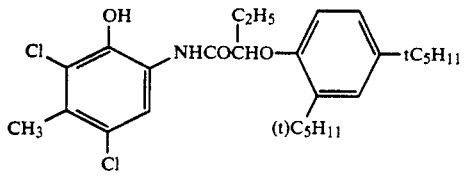

c-1

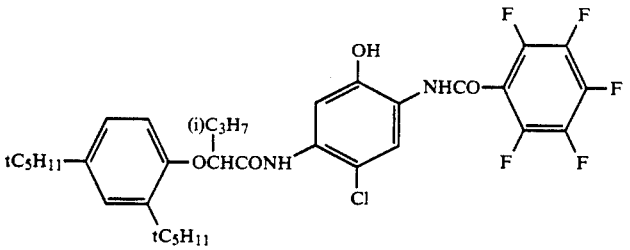

c-2

The multi-layered color photographic paper sheet was imagewisely exposed to light, and then the exposed color photographic paper sheet was processed continuously in each of the processes D, E, F, G, H and I until the quantity of each replenisher reached three times of the volume of the tank of the color developing apparatus.

Washing was effected while allowing rinsing water to flow in the direction from the Rinse 4 to the Rinse 1.

The color developing solutions used in the processes D to G are as follows.

| Processing Step | Temperature | D Comp. Ex. | E Comp. Ex. | F Comp. Ex. | G Comp. Ex. | H Present Invention | I Present Invention |
|---|---|---|---|---|---|---|---|
| Color Development | 35° C. | 45 sec | 45 sec | 45 sec | 45 sec | 45 sec | 45 sec |
| Bleaching-and-Fixing | 35° C. | 90 sec | 45 sec | 90 sec | 45 sec | 45 sec | 30 sec |
| Rinse 1 | 35° C. | 30 sec | 30 sec | 15 sec | 15 sec | 15 sec | 10 sec |
| Rinse 2 | 35° C. | 30 sec | 30 sec | 15 sec | 15 sec | 15 sec | 10 sec |
| Rinse 3 | 35° C. | 30 sec | 30 sec | 15 sec | 15 sec | 15 sec | 10 sec |
| Rinse 4 | 35° C. | 30 sec | 30 sec | 15 sec | 15 sec | 15 sec | 10 sec |
| Drying | 80° C. | 60 sec | 60 sec | 60 sec | 60 sec | 60 sec | 60 sec |

(Times for transportation between baths are subtracted from the processing time.)

| Color Developer | Liquid in Tank | Re-prenisher |
|---|---|---|
| Water | 800 ml | 800 ml |
| Diethylenamine Pentaacetate | 3.0 g | 3.0 g |
| 1-Hydorxyethylidene-1,1-diphosphonic Acid | 1.5 ml | 1.5 ml |
| Lithium Sulfate | 1.0 g | 1.0 g |
| Benzyl Alcohol | 15 ml | 15 ml |
| Diethylene Glycol | 10 ml | 10 ml |
| Sodium Sulfite | 1.7 g | 1.7 g |
| Sodium Chloride | 1.5 g | 0.7 g |
| Adenine | 30 mg | 30 mg |
| 1,2,3-Benzotriazole | 2 mg | 5 mg |
| Potassium Carbonate | 40 g | 40 g |
| N-Ethyl-N-(β-methanesulfonamideethyl)-3-methyl-4-aminoanilinesulfate | 5.5 g | 9.0 g |
| Fluorecent Brightening Agent (Whitex 4; produced by Sumitomo Chemical, Co.) | 1.0 g | 2.5 g |
| (Adding Balance Water) | 1000 ml | 1000 ml |
| (pH Adjusted by KOH) | pH 10.50 | pH 11.0 |

Meantime, in the processes H and I, used were color developing solutions which were deprived of benzyl alcohol from the processing solutions set forth above.

The bleaching-and-fixing solutions used in the processes D to I were the same as used in Example 1. As to the rinsing solution, the same rinsing solution was used both as the replenisher and the liquid contained in the tank.

| Composition of Rinsing Solution | |
|---|---|
| Ethylenediamine Tetraacetate.2Na | 200 mg |
| Sulfanylamide | 100 mg |
| 1-Hydroxyethylidene-1,1-diphosphonic Acid (60%) | 2.5 ml |
| Aqueous Ammonia (26%) | 2 ml |
| Ammonium Alum | 0.5 g |
| (Adding Balance Water) | 1000 ml |
| (pH Adjusted by KOH) | pH 7.0 |

The quantities of the replenished color developer solution, bleaching-and-fixing solution and rinsing solution were, respectively 160 ml, 60 ml and 120 ml per 1 $m^2$ of the color photographic rint paper.

The white ground portion (unexposed area) of the photographic print paper, which had been processed at the time of the termination of the continuous processing, was allowed to stand a 70° C./70% humidity for 20 days, and then the increase in yellow stain density was measured.

A further experiment was conducted to learn the decolorization ratio or factor of yellow color. The experiment was conducted such that the portion having the highest density on the photographic print paper (the portion having a density on about 2.0 when measured through a reflection densito eter) was irradiated with a xenon light of 80,000 luxes for 14 days, and the decolorization factor was measured after then.

A still further experiment was conducted to learn the time (days) from the time of the termination of the continuous processing to the time at which any floating contaminants were bserved on the surfaces of the rinsing solutions (Rinse 1 to 4), while the automatic developing machine being stopped at the termination of continuous processing.

The results of the aforementioned experiments are shown in Table 4.

TABLE 4

| Process | Yellow Stain | Degree of Decoloration of Yellow Light (%) | Time (days) until Floating Contaminants Found | | | |
|---|---|---|---|---|---|---|
| | | | Rinse 1 | Rinse 2 | Rinse 3 | Rinse 4 |
| D (Comparative Example) | +0.33 | 31 | —* | 6 | 4 | 5 |
| E (Comparative Example) | +0.37 | 38 | — | 5 | 4 | 4 |
| F (Comparative Example) | +0.38 | 45 | — | 5 | 4 | 4 |
| G (Comparative Example) | +0.51 | 65 | — | 2 | 1 | 2 |
| H (Present Invention) | +0.32 | 29 | — | 14 | 12 | — |
| I (Present Invention) | +0.33 | 30 | — | 10 | 8 | — |

*Note: No floating contaminant found by 20 days from the standstill of the system.

As will be seen from Table 5, the image preservabilty was seriously deteriorated with an increasing intention of formation of floating contaminants in the process G wherein the times for the bleaching-and-fixing step and for the washing or rinsing step were cut down, as compared to the process D wherein times both for the bleaching-and-fixing step and for the washing or rinsing step were sufficiently long. In contrast thereto, in the processes H and I wherein benzyl alcohol was removed according to the spirit of this invention, both properties were not deteriorated and the formation of floating contaminants was rather hindered as seen by comparison with the process D.

EXAMPLE 5

Another embodiment of multi-layerd color photographic print paper was prepared similarly as in Example 1, except that the following modifications (i) to (iii) were adopted. (i) A coating solution or emulsion for forming the first layer was prepared similar to that used in Example 1, except that the following silver halide emulsion (1) containing 1.0 mol % of silver bromide was used, and that the content of a blue-sensitive sensitizing dye was set to 5.0×10−4 "ols/l mol of silver chlomobromide.

| Preparation of Silver Halide Emulsion (1): | |
|---|---|
| (Liquid 1) | |
| $H_2O$ | 1,000 ml |
| NaCl | 5.5 g |
| Gelatine | 32 g |
| (Liquid 2) | |
| Sulfuric Acid (1N) | 20 ml |
| (Liquid 3) | |
| Solvent for Silver Halide (1%) (Represented by the following Structural Formula) | 3 ml |

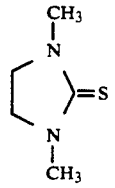

(Liquid 4)

KBr 0.18 g

-continued

| Preparation of Silver Halide Emulsion (1): | |
|---|---|
| NaCl | 8.51 g |
| Adding with $H_2O$ | 130 ml |
| (Liquid 5) | |
| $AgNO_3$ | 25 g |
| $NH_4NO_3$ (50%) | 0.5 ml |
| Added with $H_2O$ | 285 ml |
| (Liquid 6) | |
| KBr | 0.70 g |
| NaCl | 34.06 g |
| $K_2IrCl_6$ (0.001%) | 130 ml |
| Adding with $H_2O$ | 285 ml |
| (Liquid 7) | |
| $AgNO_3$ | 100 g |
| $NH_4NO_3$ (50%) | 2 ml |
| Adding with $H_2O$ | 285 ml |

The (liquid 1) was heated to 75° C., and added with (Liquid 2) and (liquid 3). Thereafter, the (Liquid 4) and the (Liquid 5) were added concurrently over a period of 60 minutes. After the lapse of 10 minutes, the (Liquid 6) and the (Liquid 7) were concurrently added over a period of 25 minutes. Five minutes after the addition of the (Liquid 6) and the (Liquid 7), the temperature of the mixture was lowered and the mixture was demineralized. Adding water and gelatine dispersed therein and adjusting the pH to 6.2, obtained was a monodisperse cubic silver chlomobromide emulsion containing 1 mol % of silver bromide and composed of particles having an average particle size of 1.02 μm and a variation factor (s/d; the factor obtained by dividing the standard deviation of particle distribution by the average particle size) of 0.08. The emulsion was sensitized by gold and sulfur, by adding $1.0\times10^{-4}$ mol/mol of silver and optimum chemical sensitization was effected by sodium thiosulfate. (iii) The coating solutions for the second to the seventh layers were prepared, generally similar to those prepared in Example 1, except that the silver halide emulsion for the coating solution of the third layer was a silver halide emulsion (2) containing 0.5 mol % of silver bromide as set forth below, and that the silver halide emulsion for the coating solution of the fifth layer was a silver halide emulsion (3) containing 1.0 mol % of silver bromide as set forth below and being added with a red-sensitive spectral sensitizer in an amount of 0.9×10−4 "ol/l mol of silver halide.

| Preparation of Silver Halide Emulsions (2) and (3): | |
|---|---|
| (Liquid 8) | |
| $H_2O$ | 1,000 ml |
| NaCl | 5.5 g |
| Gelatine | 32 g |
| (Liquid 9) | 24 ml |

-continued

| Preparation of Silver Halide Emulsions (2) and (3): | |
|---|---|
| Sulfuric Acid (1N) | |
| (Liquid 10) | |
| Solvent for Silver Halide (1%) | |
| (As set forth hereinabove as Liquid 2) | 3 ml |
| (Liquid 11) | |
| KBr | 0.11 g |
| NaCl | 10.94 g |
| Adding with $H_2O$ | 220 ml |
| (Liquid 12) | |
| $AgNO_3$ | 32 g |
| Added with $H_2O$ | 200 ml |
| (Liquid 13) | |
| KBr | 0.45 g |
| NaCl | 43.83 g |
| $K_2IrCl_6$ (0.001%) | 4.5 ml |
| Adding with $H_2O$ | 600 ml |
| (Liquid 14) | |
| $AgNO_3$ | 128 g |
| Adding with $H_2O$ | 600 ml |

The (liquid 8) was heated to 56° C., and added with (Liquid 9) and (liquid 10). Thereafter, the (Liquid 11) and the (Liquid 12) were added concurrently over a period of 10 minutes. After the lapse of additional 10 minutes, the (Liquid 13) and the (Liquid 14) were concurrently added over a period of 8 minutes. Five minutes after the addition of the (Liquid 13) and the (Liquid 14), the temperature of the mixture was lowered and the mixture was demineralized. Adding water and gelatine dispersed therein and adjusting the pH to 6.2, obtained was a monodisperse cubic silver chlomobromide emulsion containing 0.5 mol % of silver bromide and composed of particles having an average particle size of 0.45 μm and a variation factor of 0.08. The emulsion was sensitized by gold by the addition of $4.1\times10^{-4}$ mol/l mol of silver.

Likewise, the compositions and temperatures of the (Liquid 11) and the (Liquid 13) were changed to obtain a monodisperse cubic silver chlomobromide emulsion containing 1 mol % of silver bromide and composed of particles having an average particle size of 0.51 μm and a variation factor of 0.07. The emulsion was sensitized by gold and sulfur to prepare an emulsion (3). The amount of gold added was of $4.1\times10^{-4}$ mol/mol of silver, and the emulsion was chemically sensitized to optimum state by the addition of sodium thiosulfate.

(iii) The cyan coupler used was a mixture of $K_1$ and $K_2$, while $K_2$ was changed to the compound represented by the following structural formula of:

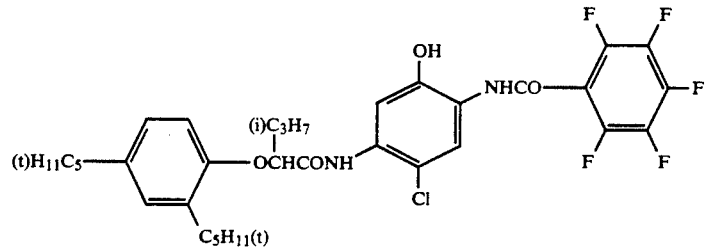

The thus prepared color photographic paper was subjected to continuous processing, through the processing steps J, K, L, M, N and O, until the replenisher had been fed in an amount of three times as large as the volume of the tank of the color developer.

| Processing Step | Temperature | Comparative Example J | K | L | M | Present Invention N | O |
|---|---|---|---|---|---|---|---|
| Color Development | 35° C. | 45 sec | 45 sec | 45 sec | 45 sec | 45 sec | 45 sec |
| Bleaching-and-Fixing | 35° C. | 90 sec | 45 sec | 90 sec | 45 sec | 45 sec | 30 sec |
| Rinse 1 | 30° C. | 40 sec | 40 sec | 20 sec | 20 sec | 20 sec | 10 sec |
| Rinse 2 | 30° C. | 40 sec | 40 sec | 20 sec | 20 sec | 20 sec | 10 sec |
| Rinse 3 | 30° C. | 40 sec | 40 sec | 20 sec | 20 sec | 20 sec | 10 sec |
| Drying | 90° C. | 30 sec | 30 sec | 30 sec | 30 sec | 30 sec | 30 sec |

(Times for transportation between baths are subtracted from the processing time.)

The compositions of the processing solutions used in respective processes will be set forth as follows.

| Color Developer | Liquid in Tank | Reprenisher |
|---|---|---|
| Triethanol amine | 8.0 g | 10.0 g |
| N,N-Diethylhydroxylamine | 4.2 g | 6.0 g |
| Fluorescent Brightening Agent (4,4'-Diaminostilbenzene base) | 3.0 g | 4.0 g |
| Ethylenediamine Tetraacetate | 1.0 g | 1.5 g |
| Potassium Carbonate | 30.0 g | 30.0 g |
| Sodium Chloride | 1.4 g | 0.1 g |
| 4-Amino-3-methyl-N-ethyl-N-(methanesulfonamide)ethyl)-p-phenylenediamine sulfate | 5.0 g | 7.0 g |
| Benzyl Alcohol | 15 ml | 20 ml |
| (Adding Balance Water) | 1000 ml | 1000 ml |
| (pH Adjusted by KOH) | pH 10.10 | pH 10.50 |

Meantime, in the processes N and O, color developing solutions which were deprived of benzyl alcohol from the processing solutions set forth above were used.

Bleaching-and-Fixing Solution:

(The ame solution was used both as the liquid in the tank and as the replenisher.)

| | |
|---|---|
| EDTAFe(III) $NH_4.2H_2O$ | 60 g |
| EDTA.2Na.$2H_2O$ | 4 g |
| Ammonium Thiosulfate (70%) | 120 ml |
| Glacial Acetic Acid | 16 g |
| (Adding Balance Water) | 1000 ml |
| (pH Adjusted by KOH) | pH 5.5 |

Linsing Solution:

(The same solution was used both as the liquid in the tank and as the reprenisher.)

| | |
|---|---|
| EDTA 2NA 2 $H_2O$ | 0.4 g |
| (Adding Balance Water) | 1000 ml |
| pH Value | pH 7.0 |

The quantities of respective replenishers, per 1 $m^2$ of the photographic material, were as follows:

| | |
|---|---|
| Color Developing Solution | 160 ml |
| Bleaching-and-Fixing Solution | 100 ml |
| Linsing Solution | 200 ml |

Similarly as in Example 4, the increases in yellow stains and magenta stains after processing and the decolorization of yellow color were checked. Also checked was the time (days) of first occurrence of floating contaminants.

The results are shown collectively in Table 5.

As will be seen from the results set forth in Table 5, stains are increased and the degree of decolorization becomes greater as the times for the bleaching-and-fixing and/or rinsing (washing) are cut down in the Comparative Examples. In contrast thereto, by the use of the color developing solutions which are substantially free of benzyl alcohol, in other words, deprived of benzyl alcohol according to the most important feature of this invention, the stabilities of the photographic image and the rinsing solutions are remarkedly improved.

TABLE 5

| Process | Stain Yellow | Stain Magenta | Degree of Decoloration of Yellow Light | Time (days) until Floating Contaminants Found Rinse 1 | Rinse 2 | Rinse 3 |
|---|---|---|---|---|---|---|
| J (Comparative Example) | +0.20 | +0.04 | 29 | —* | 8 | 8 |
| K (Comparative Example) | +0.26 | +0.10 | 38 | — | 3 | 3 |
| L (Comparative Example) | +0.27 | +0.11 | 41 | — | 3 | 3 |
| M (Comparative Example) | +0.34 | +0.21 | 60 | — | 1 | 2 |
| N (Present Invention) | +0.20 | +0.04 | 29 | — | 15 | 13 |
| O (Present Invention) | +0.21 | +0.05 | 30 | — | 12 | 10 |

*Note: No floating contaminant found by 20 days from the standstill of the system.

What is claimed is:

1. A processing method for an exposed silver halide color photographic material containing a magenta coupler selected from compounds represented by formulae (IV) and (V):

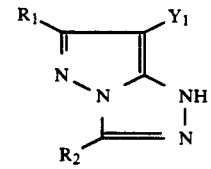

(IV)

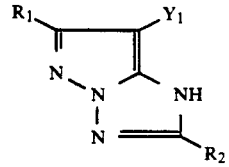

(V)

wherein $R_1$ and $R_2$ each represent a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and $Y_1$ represents a hydrogen atom, a halogen atom, a carboxyl group or a group combined with the carbon at the coupling site through an oxygen, nitrogen or sulfur atom to be released upon coupling;

said processing method comprising the continuous steps of:

(i) color developing said exposed silver halide color photographic material having a reflecting support with a color developing solution containing no benzyl alcohol;

(ii) subjecting said silver halide color photographic material to bleaching-and-fixing with a bleaching-and-fixing solution for not more than 70 seconds; and (iii) washing said silver halide color photographic material with an aqueous washing solution for not more than 70 seconds; and (iv) replenishing at least one of the color developing solution, bleaching-and-fixing solution and washing solution.

2. The processing method for a silver halide color photographic material as set forth in claim 1, wherein said washing is conducted by using a multistage counter-flow washing baths to greatly reduce an amount of washing water and the content of ingredients of the bleaching-and-fixing solution in the final washing bath is not more than $5\times10^{-2}$.

3. The processing method for a silver halide color photographic material as set forth in claim 2, wherein the content of ingredients of the bleaching-and-fixing solution in the final washing bath is not more than $1\times10^{-2}$.

4. The processing method for a silver halide color photographic material as set forth in claim 1, wherein the silver halide emulsion has a deviation coefficient of not more than 20%.

5. The processing method for a silver halide color photographic material as in claim 4, wherein the silver halide emulsion has a deviation coefficient of not more than 15%.

6. The processing method for a silver halide color photographic material as in claim 1, wherein the silver halide emulsion contains silver halide grains having a cubic or tetradecahedral crystal form.

7. The processing method for a silver halide color photographic material as set forth in claim 1, wherein the time for the bleaching-and-fixing of said silver halide color photographic material is not more than one minute.

8. The processing method for a silver halide color photographic material as set forth in claim 7, wherein the time for the bleaching-and-fixing of said silver halide color photographic material ranges within 20 seconds to one minute.

9. The processing method for a silver halide color photographic material as set forth in claim 1, wherein the bleaching agent used in the bleaching-and-fixing step is selected from the group consisting of one or mixtures of the complexes of iron (III) with aminopolycarboxylic acids, aminopolyphosphonic acids, phosphonocarboxylic acids and organic phosphonic acids.

10. The processing method for a silver halide color photographic material as set forth in claim 9, wherein the bleaching agent used in said bleaching-and-fixing step contains said bleaching agent in an amount of from 0.075 mol to 2.0 mols in one liter of the bleaching-and-fixing solution.

11. The processing method for a silver halide color photographic material as set forth in claim 1, wherein the fixing agent used in the bleaching-and-fixing step is a thiosulfate.

12. The processing method for a silver halide color photographic material as set forth in claim 11, wherein the fixing agent used in said bleaching-and-fixing step contains said fixing agent in an amount of from 0.3 mols to 3 mols in one liter of the bleaching-and-fixing solution.

13. The processing method for a silver halide color photographic material as set forth in claim 1, wherein the time for washing ranges within 20 seconds to one minute.

14. The processing method for a silver halide color photographic material as set forth in claim 1, wherein the aqueous washing solution is a stabilizing solution containing an image stabilizing agent.

15. The processing method for a silver halide color photographic material as set forth in claim 1, wherein the aqueous washing solution is an aqueous solution containing one or more of a chelating agent, a germicide and an antifungal agent.

16. The processing method for a silver halide color photographic material as set forth in claim 1, wherein the color photographic material is developed by an aromatic primary amine developing agent.

17. The processing method for a silver halide color photographic material as set forth in claim 16, wherein the aromatic primary amine developing agent is 3-methyl-4-amino-N-ethyl-N-β-methanesulfonamidoethylaniline or 3-methyl-4-amino-N-ethyl-N-β-hydroxyethylaniline.

18. The processing method for a silver halide color photographic material as set forth in claim 16, wherein the aromatic primary amine developing agents is 3-methyl-4-amino-4-ethyl-N-β-methanesulfonamidoethylaniline.

19. The processing method for a silver halide color photographic material as set forth in claim 1, wherein the aqueous washing solution is water.

* * * * *